US008025021B2

(12) United States Patent
Gosling

(10) Patent No.: US 8,025,021 B2
(45) Date of Patent: Sep. 27, 2011

(54) SUBMERSIBLE VEHICLE

(75) Inventor: Harry George Dennis Gosling, Bristol (GB)

(73) Assignee: GO Science Limited, Bristol (GB)

( * ) Notice: Subject to any disclaimer, the term of this patent is extended or adjusted under 35 U.S.C. 154(b) by 275 days.

(21) Appl. No.: 12/090,547

(22) PCT Filed: Oct. 19, 2006

(86) PCT No.: PCT/GB2006/003901

§ 371 (c)(1),
(2), (4) Date: Apr. 17, 2008

(87) PCT Pub. No.: WO2007/045887

PCT Pub. Date: Apr. 26, 2007

(65) Prior Publication Data

US 2008/0264323 A1 Oct. 30, 2008

(30) Foreign Application Priority Data

Oct. 19, 2005 (GB) ..... 0521292.3

(51) Int. Cl.
*B63G 8/08* (2006.01)

(52) U.S. Cl. ..... 114/330; 114/312

(58) Field of Classification Search ..... 114/20.1–25, 114/312–342, 151, 122, 59, 144 RE; 440/38, 440/67–70, 6; 405/188, 189
See application file for complete search history.

(56) References Cited

U.S. PATENT DOCUMENTS

| | | | | | |
|---|---|---|---|---|---|
| 573,351 | A | * | 12/1896 | Parker | 416/189 |
| 1,281,414 | A | | 10/1918 | Pegram | |
| 1,759,511 | A | | 5/1930 | Kort | |
| 1,991,512 | A | | 2/1935 | Miller | |
| 2,823,636 | A | * | 2/1958 | Gongwer et al. | 114/332 |
| 2,952,235 | A | * | 9/1960 | Salomon | 114/125 |
| 3,134,353 | A | | 5/1964 | Pederson et al. | |
| 3,464,357 | A | | 9/1969 | Duport et al. | |
| 3,611,966 | A | | 10/1971 | Hunter | |
| 3,677,212 | A | * | 7/1972 | Gregoire | 114/316 |
| 3,893,403 | A | | 7/1975 | Gay, Jr. et al. | |
| 3,939,794 | A | * | 2/1976 | Hull | 440/38 |
| 3,943,875 | A | * | 3/1976 | Sanders | 114/244 |
| 4,063,240 | A | * | 12/1977 | Isbister et al. | 342/21 |
| 4,282,823 | A | | 8/1981 | Santi | |
| 4,392,443 | A | * | 7/1983 | De Marco | 114/20.1 |
| 4,967,983 | A | | 11/1990 | Motts | |
| 5,058,082 | A | | 10/1991 | Bertheas et al. | |
| 5,303,552 | A | | 4/1994 | Webb | |

(Continued)

FOREIGN PATENT DOCUMENTS

DE 3149618 7/1983

(Continued)

*Primary Examiner* — Edwin Swinehart
(74) *Attorney, Agent, or Firm* — Barnes & Thornburg LLP; Mark J. Nahnsen

(57) ABSTRACT

A submersible vehicle having an outer hull which defines a hull axis and appears substantially annular when viewed along the hull axis, the interior of the annulus defining a duct which is open at both ends so that when the vehicle is submerged in a liquid, the liquid floods the duct. The vehicle further comprising means for rolling the vehicle about the hull axis. A buoyancy control system may be provided, and the outer hull may be swept with respect to the hull axis. Various methods of deploying and using the vehicle are described.

3 Claims, 15 Drawing Sheets

U.S. PATENT DOCUMENTS

| | | | | |
|---|---|---|---|---|
| 5,413,461 | A * | 5/1995 | Johnsen | 416/1 |
| 5,438,947 | A | 8/1995 | Tam | |
| 5,447,115 | A * | 9/1995 | Moody | 114/312 |
| 5,687,670 | A | 11/1997 | Rice | |
| 5,758,592 | A * | 6/1998 | Benson, Jr. | 114/330 |
| 5,864,515 | A | 1/1999 | Stinchcombe | |
| 6,328,622 | B1 | 12/2001 | Geery | |
| 6,349,663 | B1 | 2/2002 | Romano | |
| 6,443,799 | B1 | 9/2002 | Gibson | |
| 6,647,909 | B1 | 11/2003 | Norek | |
| 6,845,937 | B2 | 1/2005 | August | |
| 2002/0083880 | A1 | 7/2002 | Shelton et al. | |
| 2002/0178990 | A1 | 12/2002 | McBride et al. | |
| 2003/0214580 | A1 | 11/2003 | Iddan | |
| 2004/0195440 | A1 | 10/2004 | Liu | |
| 2004/0196737 | A1 | 10/2004 | Nicholson | |
| 2005/0109259 | A1 | 5/2005 | August | |

FOREIGN PATENT DOCUMENTS

| | | |
|---|---|---|
| DE | 4300497 | 11/1996 |
| EP | 0903288 | 3/1999 |
| GB | 1187835 | 4/1970 |
| GB | 2371034 | 7/2002 |
| RU | 2796 U1 | 9/1996 |
| RU | 2142385 C1 | 12/1999 |
| RU | 2185304 C1 | 7/2002 |

* cited by examiner

Front Axial View

Port Elevation

Plan View

Elevation View

Perspective View

Elevation View

Perspective View

Front Axial View

Port Elevation

Plan View

Port Elevation
700
701
702
703
704
708

Front View
700
702
703
705
706
707
708

Port Elevation

Front View

Elevation View

Axial View

Axial View

SUBMERSIBLE VEHICLE

CROSS-REFERENCE TO RELATED PATENT APPLICATIONS

This application is a U.S. Nationalization of International Patent Application no. PCT/GB2006/003901, filed Oct. 19, 2006, which claims priority to United Kingdom Patent Application No. 0521292.3, filed Oct. 19, 2005, all of which applications are expressly incorporated herein by reference in their entirety.

The present invention relates to a submersible vehicle; and to methods of operating, docking, and deploying such a vehicle. It should be noted that in this specification the term "submersible" is intended to cover surface vehicles which are only partly submerged when in use, as well as vehicles which are fully submerged in water (or any other liquid) when in use. The invention also relates to a submersible toy glider.

An internal passage underwater vehicle is described in U.S. Pat. No. 5,438,947. The vehicle has propellers mounted in the passage, and a rudder to control the going direction of the vehicle. The vehicle is designed with a low aspect ratio to enable the vehicle to travel at high speed.

A first aspect of the present invention provides a submersible vehicle having an outer hull which defines a hull axis and appears substantially annular when viewed along the hull axis, the interior of the annulus defining a duct which is open at both ends so that when the vehicle is submerged in a liquid, the liquid floods the duct, the vehicle further comprising means for rolling the vehicle about the duct.

When in use, the vehicle may be rolled about the duct through less than one revolution, or through a plurality of revolutions. The vehicle may roll symmetrically about the hull axis, or may roll about the duct in an eccentric manner, particularly if the centre of gravity is offset from the hull axis.

Conventionally, a substantially annular shape has been considered to be undesirable because it results in a vehicle which can be unstable in roll (that is, rotation about the duct). However, the inventor has recognized that this property is not necessarily detrimental in many applications (particularly involving un-manned or autonomous vehicles) and can be exploited since roll generates angular momentum and offers greater stability as a consequence. Furthermore, vehicle roll may be combined with prevailing ocean currents to generate magnus forces which serve to reduce lateral drift away from the axis of the vehicle, in exchange for increases in hydrodynamic lift or down-thrust, as would correspond to the vectors of ocean current and vehicle roll. Such reductions in lateral drift can be valuable where precise navigation of the vehicle between two or more way points is required. Also, vehicle roll can be utilized to achieve two dimensional scanning of a sensor, where continuous roll in combination with linear motion along the vehicle axis is utilized by a sensor device to capture information from a projected rectangular field of view. The width of the rectangular field of view is determined by the magnitude of the sector in which the sensor captures information; and the length of the rectangular field of view is determined by the length of axial travel of the vehicle. Typically the sector would subtend an angle less than 180°, but in an extension of this method the sensor device sensor may capture information beyond 180° and up to 360°. In this case the projected field of view will be continuous around the two dimensional plane subtended by the vehicle's roll motion. In such an example the sensor device captures data in a synchronous manner in relation to its angular attitude, so that successive lines may be formed with accurate registration between them. In a preferred embodiment, synthetic extension of the sensor's aperture in two dimensions is achieved by suitable processing of sensor data. In this particular example one of the limiting factors on performance in synthetic aperture processing is loss of resolution because of inaccuracies between estimated and actual vehicle position throughout the data capture period. As a consequence such systems have introduced inertial navigation equipment to increase the accuracy to which the vehicle's position and attitude may be estimated. Preferred embodiments of the invention, however, adopt instead a less costly and more elegant design that improves the basic stability of the vehicle by increasing its angular momentum and therefore reducing the extent of drift in either vehicle position or attitude without recourse to complex correction or estimation algorithms. Thus in the preferred embodiments described below, various means are provided for control of vehicle roll about the duct, and other elements of attitude control.

The means for rolling the vehicle about the duct may be for example a propulsion system (such as a twin thrust vector propulsion system); one or more control surfaces such as fins; an inertial control system; or a buoyancy control system which is moved to port or starboard around the hull under motor control.

Typically the vehicle further comprising a buoyancy control system, and preferably the buoyancy control system has rotational symmetry about the hull axis.

Typically, at least part of the outer hull is swept with respect to the hull axis.

Typically the hull has a projected area S, and a maximum outer diameter B normal to the hull axis, and wherein the ratio $B^2/S$ is greater than 0.5.

The relatively large diameter hull enables an array of two or more sensors to be well spaced apart on the hull, providing a large sensor baseline. In this way the effective acuity of the sensor array increases in proportion to the length of the sensor baseline. Also, the relatively high ratio $B^2/S$ gives a high ratio of lift over drag, enabling the vehicle to be operated efficiently as a glider.

Typically the interior of the annulus is shaped so as to appear at least partly curved when viewed in a cross section taken along the hull axis.

Typically the interior and exterior of the annulus are shaped so as to provide a hydrofoil profile when viewed in a cross section taken along the hull axis. Preferably the hydrofoil profile has a relatively wide section at an intermediate position along the hull axis, and relatively narrow sections fore and aft of the intermediate position.

Typically the vehicle further comprises one or more pressure vessels housed inside the outer hull. At least one of the pressure vessels may appear substantially annular when viewed along the hull axis. Two or more pressure vessels may be spaced apart along the hull axis. Typically an interior space between the pressure vessel(s) and the outer hull is flooded when in use.

Typically the vehicle further comprises an energy source housed at least partially inside the outer hull.

Typically the vehicle further comprises one or more sensors. At least one of the sensors may comprise a proximity sensor. In this case the vehicle may further comprise a propulsion system; and a feedback mechanism for adjusting the propulsion system in response to a signal from the proximity sensor.

Typically the vehicle has a center of gravity located in the duct and a center of buoyancy located in the duct.

Typically the vehicle has a center of gravity located approximately on the hull axis and a center of buoyancy located approximately on the hull axis.

A second aspect of the invention provides a submersible vehicle having an outer hull which defines a hull axis and appears substantially annular when viewed along the hull axis, the interior of the annulus defining a duct which is open at both ends so that when the vehicle is submerged in a liquid, the liquid floods the duct; and a twin thrust vector propulsion system comprising one or more pairs of propulsion devices, each pair comprising a first propulsion device pivotally mounted on a first side of the hull axis, and a second propulsion device pivotally mounted on a second side of the hull axis opposite to the first propulsion device.

Typically each propulsion device generates a thrust vector which can be varied independently of the other propulsion device by pivoting the device. Typically each device is mounted so that it can pivot about an axis at an angle (preferably 90°) to the hull axis. The propulsion devices may be, for example, rotating propellers or reciprocating fins. The propulsion devices may be inside the duct, or outside the duct but conformal with the outer hull.

The following comments apply to all aspects of the invention.

In preferred embodiments of the invention, the duct provides a low bow cross section area to reduce drag, while further drag reduction is ensured by reduction of induced wake vortices that would otherwise be more significant when induced by a conventional planar wing, or tailplane stabilizer arrangement. The walls of the duct are preferably shaped so as generate hydrodynamic lift in an efficient manner, which may be used to assist the motion of the vehicle through the liquid.

A further advantage of the duct is that superstructure (such as propulsion devices) can be housed more safely in the duct, enabling the outer hull to present a relatively smooth conformal outer surface, which serves to reduce the risk of damage or loss through impact upon or entanglement with other underwater objects.

Embodiments of the invention provide a substantially annular profile with increased structural rigidity of the vehicle compared to others based upon conventional planar wings. This advantage may be realized either in reduced cost or mass for a vehicle with similar hydrodynamic parameters, or in deeper dive capability where either annular hull or toroidal pressure vessels contained within the hull will provide better resilience to buckling stresses.

The duct may be fully closed along all or part of its length, or partially open with a slot running along its length. The duct may also include slots or ports to assist or modify its hydrodynamic performance under certain performance conditions.

Various embodiments of the invention will now be described by way of example with reference to the accompanying drawings, in which:

FIG. 1*a* is a front view of a first propelled vehicle with its propellers in a first configuration;

FIG. 1*b* is a cross-section of the vehicle taken along the hull axis and along a line A-A in FIG. 1;

FIG. 2*a* is a front view of the vehicle with its propellers in a second configuration;

FIG. 2*b* is a cross-section of the vehicle taken along a line A-A in FIG. 2*a;*

FIG. 3*a* is a rear view of a second propelled vehicle;

FIG. 3*b* is a cross-section of the vehicle taken along a line A-A in FIG. 3*a;*

FIG. 4*a* is a rear view of a third propelled vehicle;

FIG. 4*b* is a cross-section of the third propelled vehicle taken along a line A-A in FIG. 4*a;*

FIG. 4*c* is a cross-section of the vehicle taken along a line B-B in FIG. 4*a;*

FIG. 5*a* is a front view of a first glider vehicle;

FIG. 5*b* is a side view of the first glider vehicle;

FIG. 5*c* is a plan view of the first glider vehicle;

FIG. 5*d* is a side view of another glider where feathered vanes are included within slots about the elevations of the annulus;

FIG. 6*a* is a perspective view of an alternative pressure vessel;

FIG. 6*b* is a side view of the alternative pressure vessel;

Figure 9A:
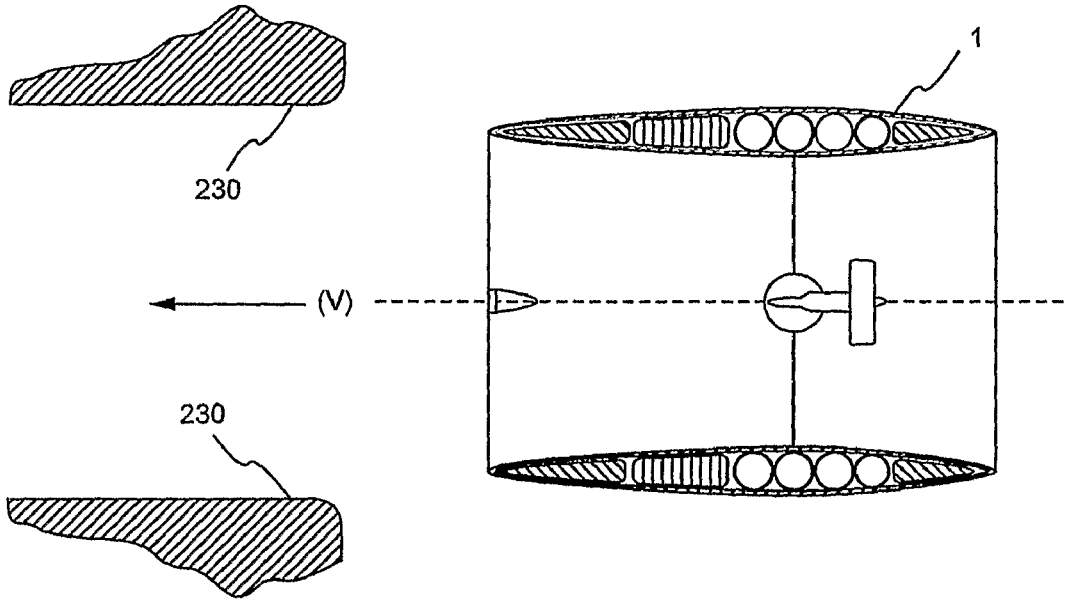
Figure 9B:
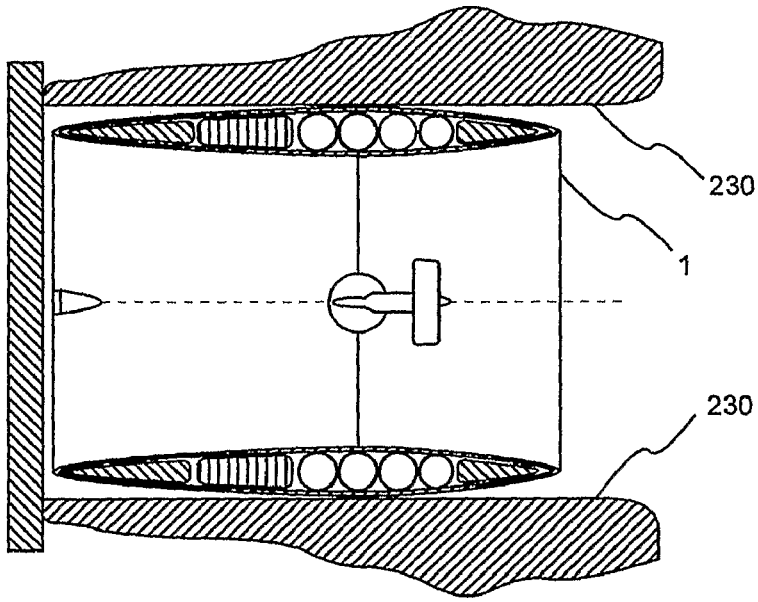
Figure 9C:
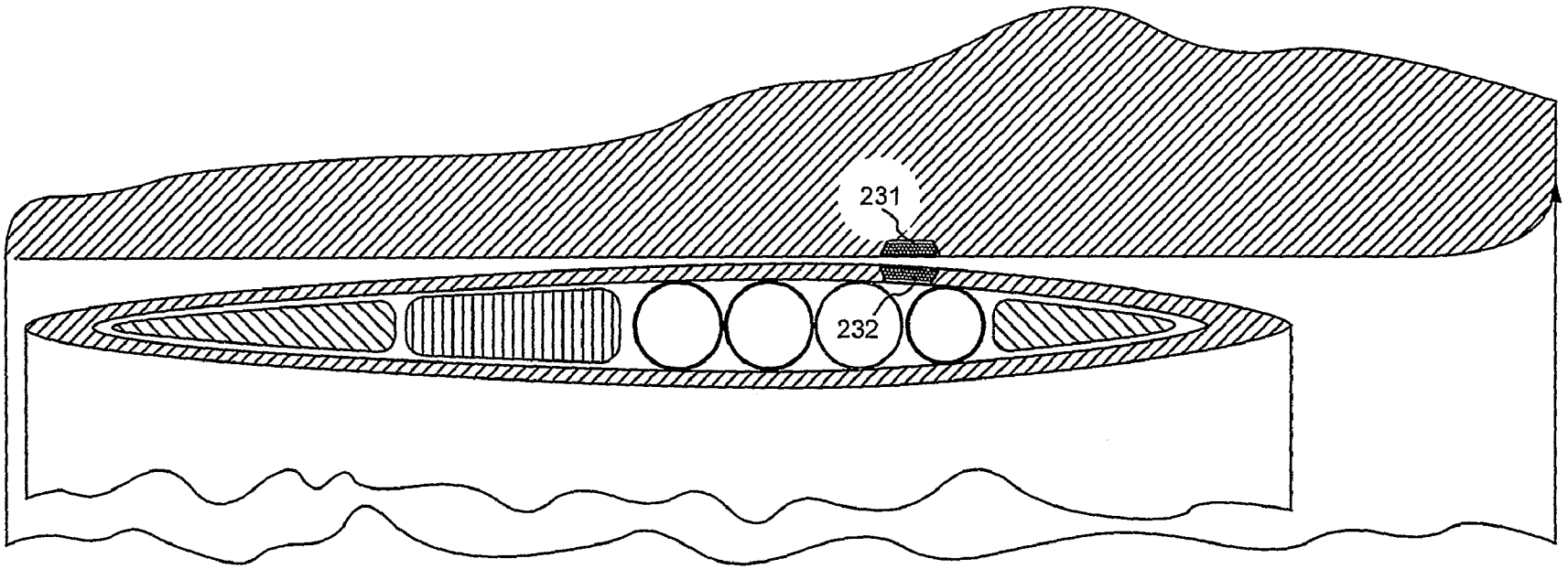
Figure 10:
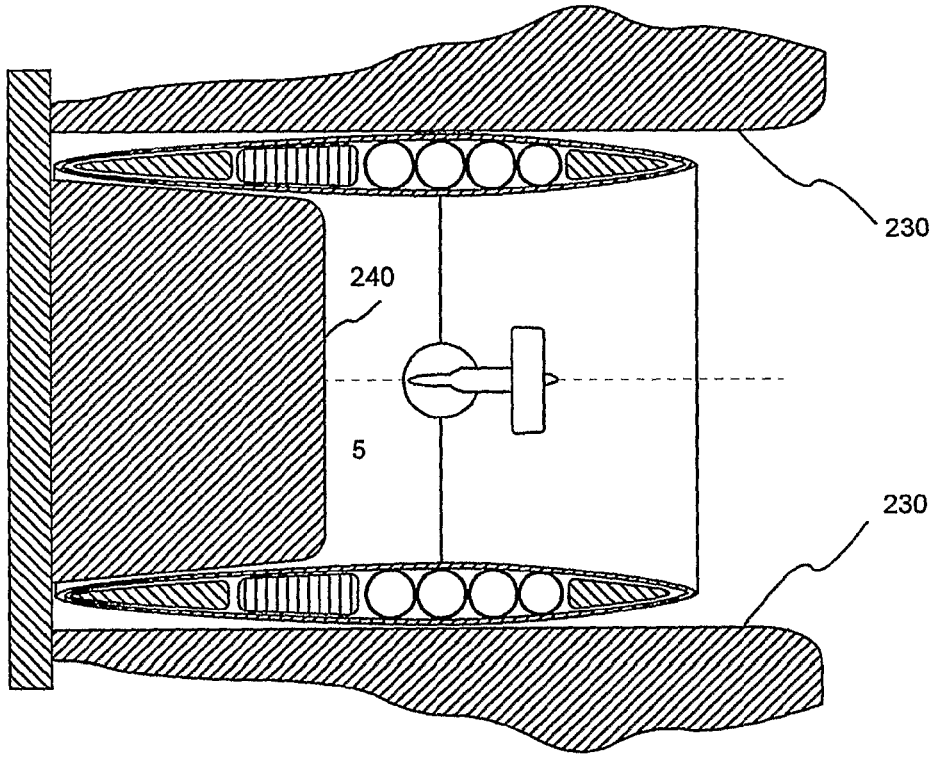
Figure 11:
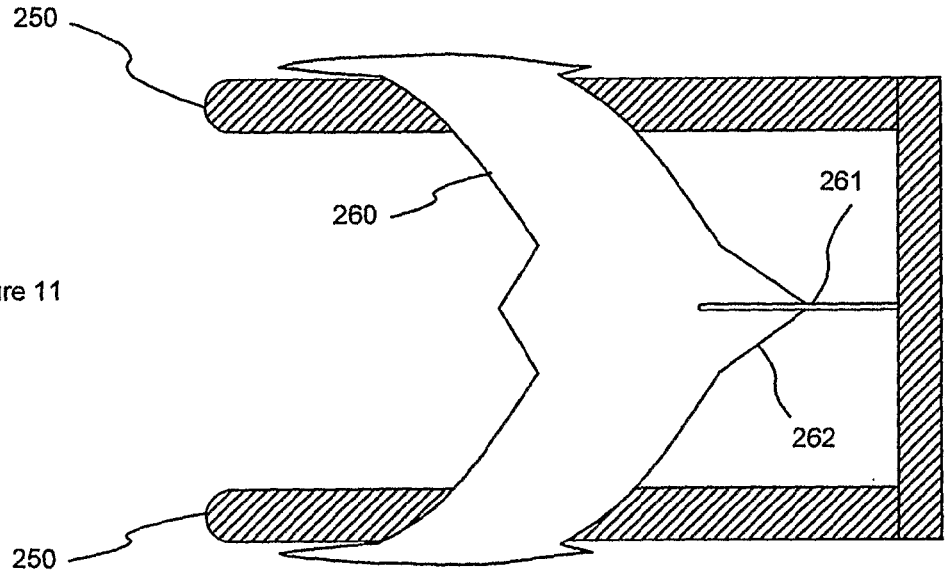
Figure 12A:
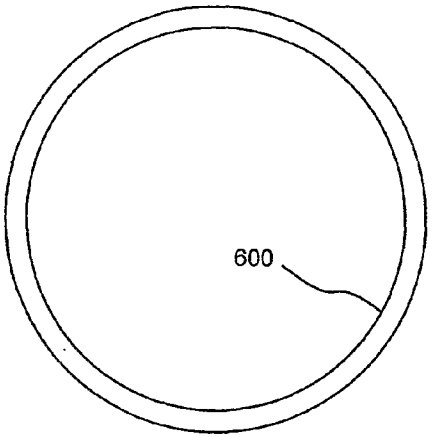
Figure 12B:
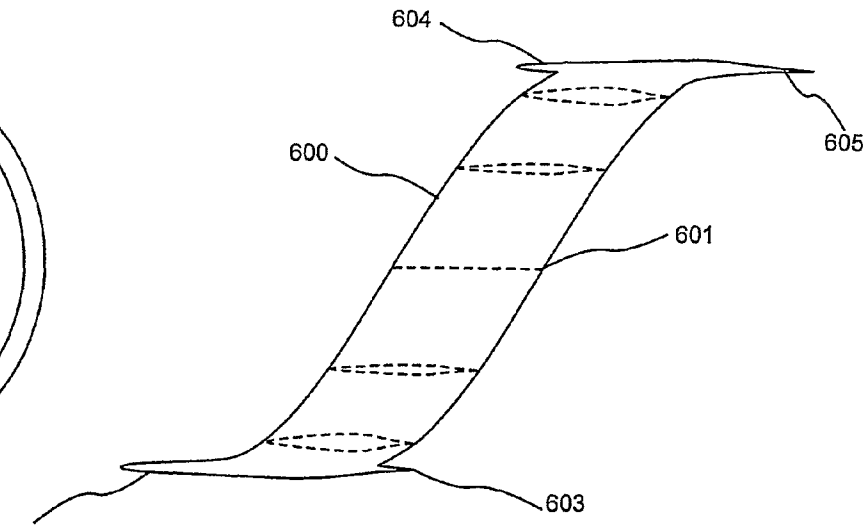
Figure 12C:
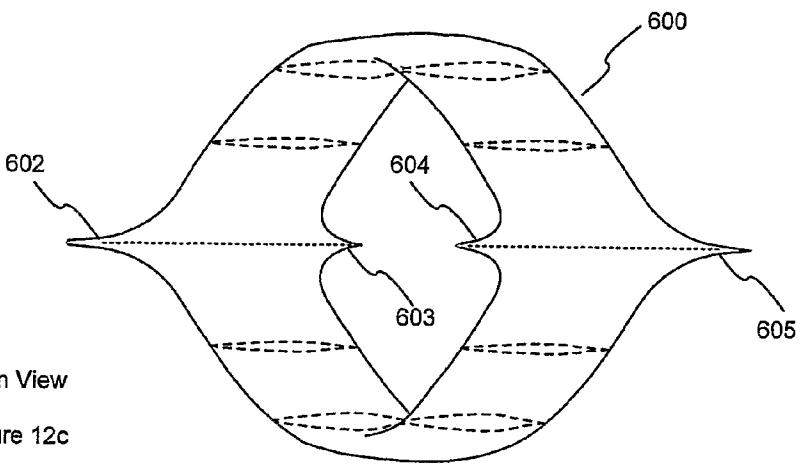
Figures 13A, 13B:
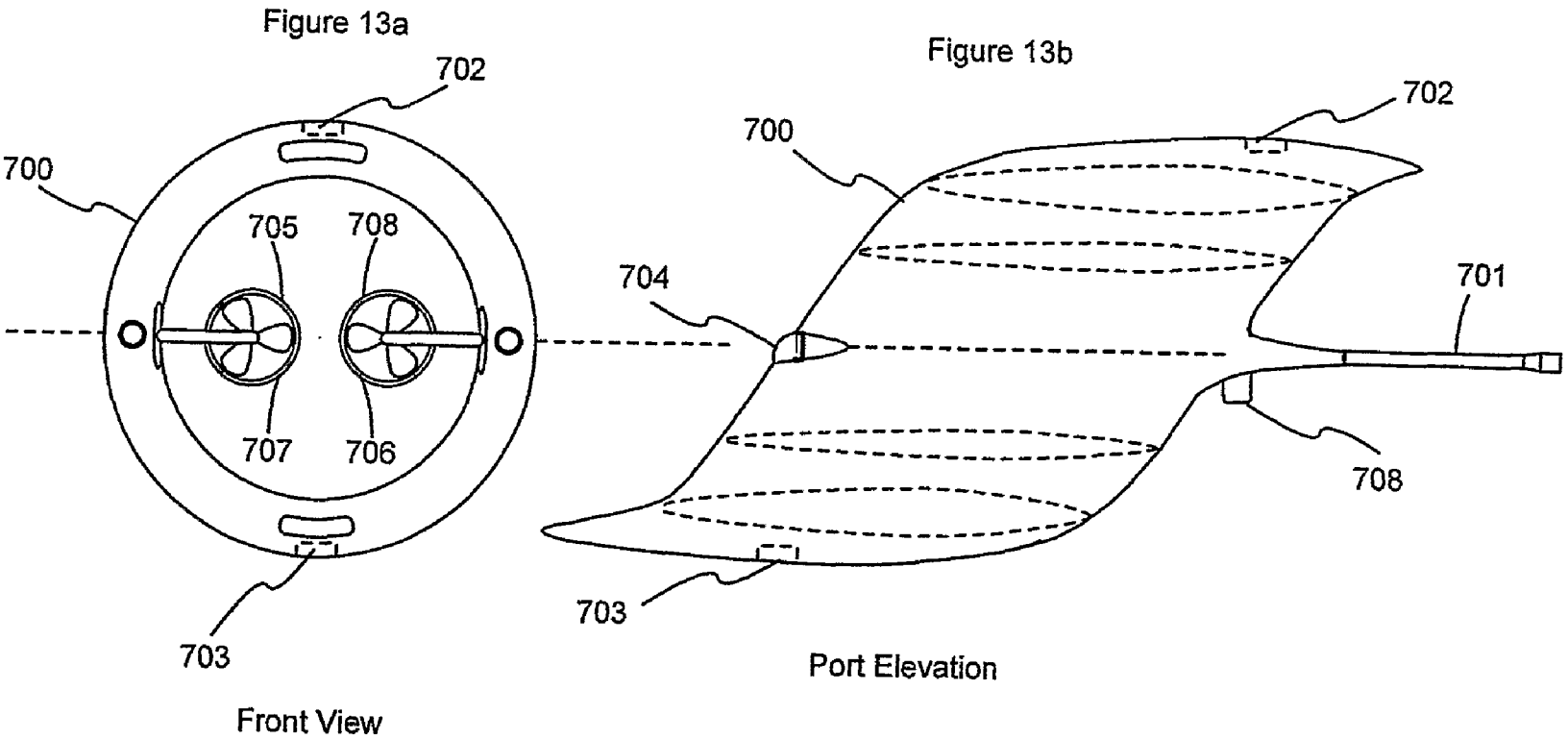
Figures 14A, 14B:
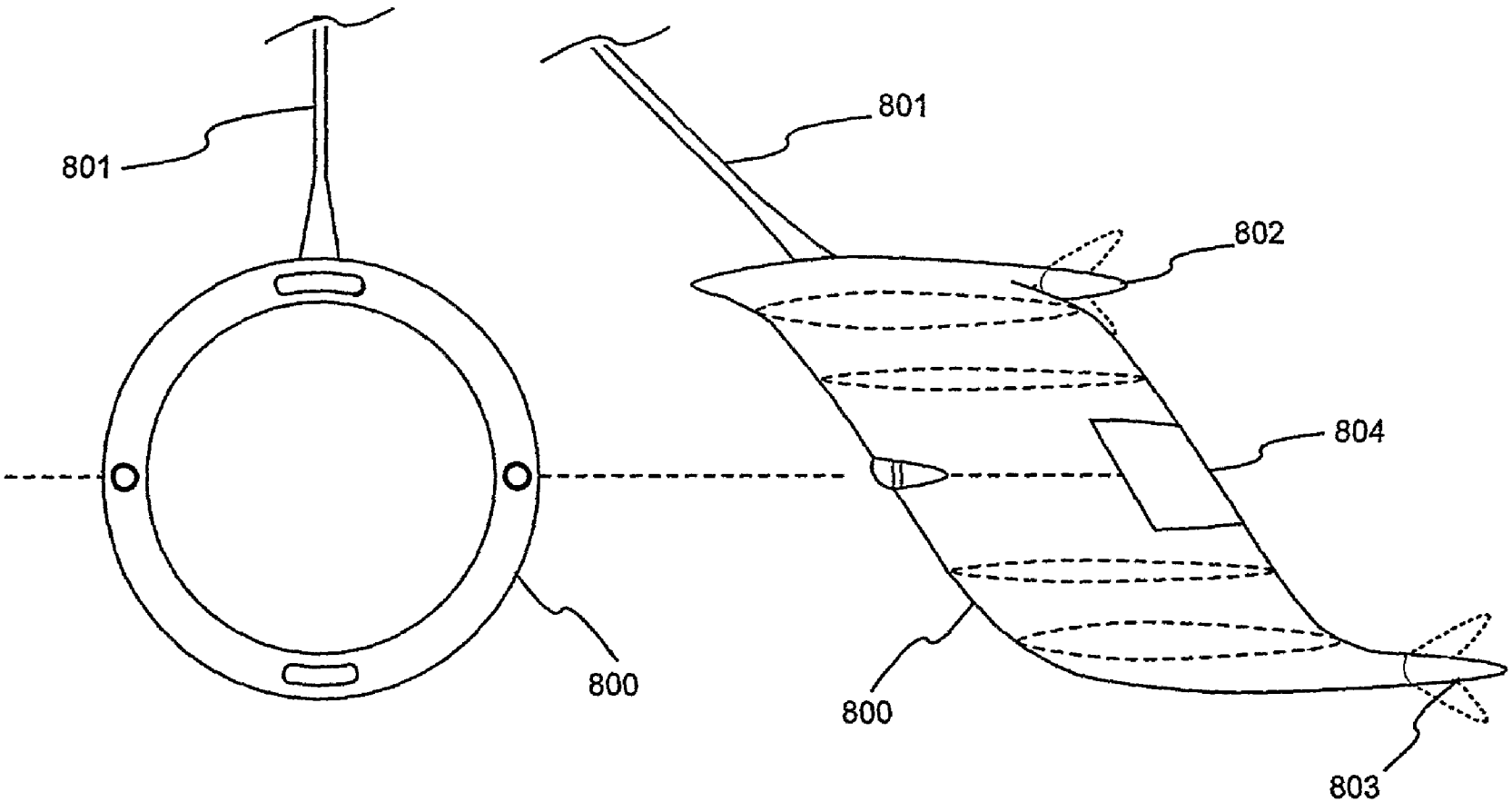

FIG. 9*a* is a cross-section of the first propelled vehicle taken along a line A-A in FIG. 1, in the process of docking;

FIG. 9*b* shows the vehicle after docking;

FIG. 9*c* is an enlarged view showing an inductive electrical recharge system;

FIG. 10 is a cross-section showing an alternative docking structure;

FIG. 11 is a schematic view of a towed tethered vehicle with a further alternative docking structure;

FIG. 12*a* is a front view of a glider vehicle;

FIG. 12*b* is a side view of the vehicle;

FIG. 12*c* is a plan view of the vehicle;

FIG. 13*a* is a front view of a fourth propelled vehicle;

FIG. 13*b* is a side view of the vehicle;

FIG. 14*a* is a front view of a second towed tether vehicle;

FIG. 14*b* is a side view of the vehicle.

Figure 15C:
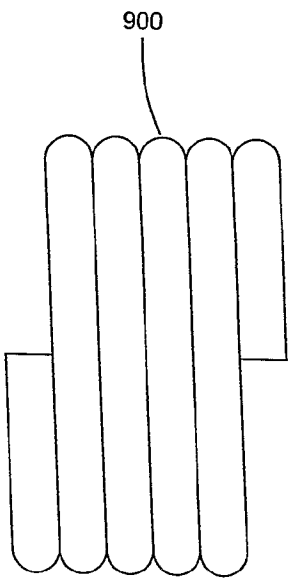
Figure 15B:
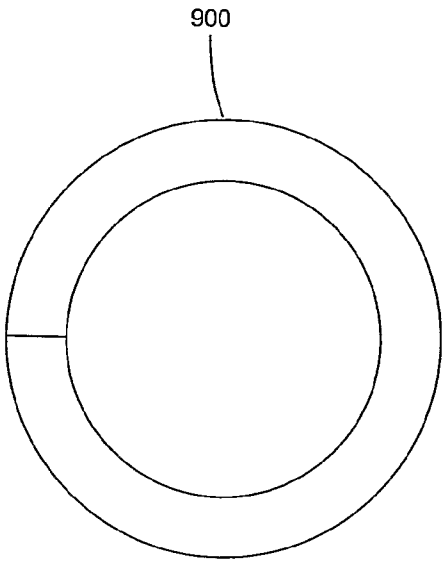
Figure 15A:
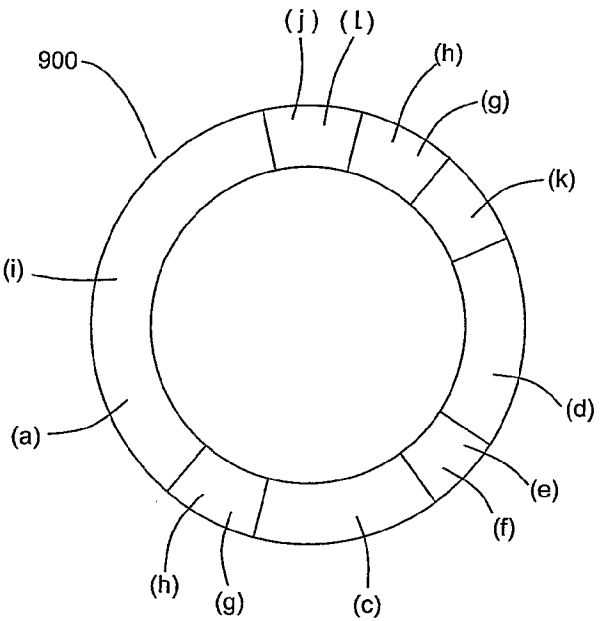

FIG. 15*a* is an axial view of a toroidal buoyancy control system;

FIG. 15*b* is an axial view of a helical buoyancy control system;

FIG. 15*c* is a side view of the system of FIG. 15*b*; and

Figure 15D:
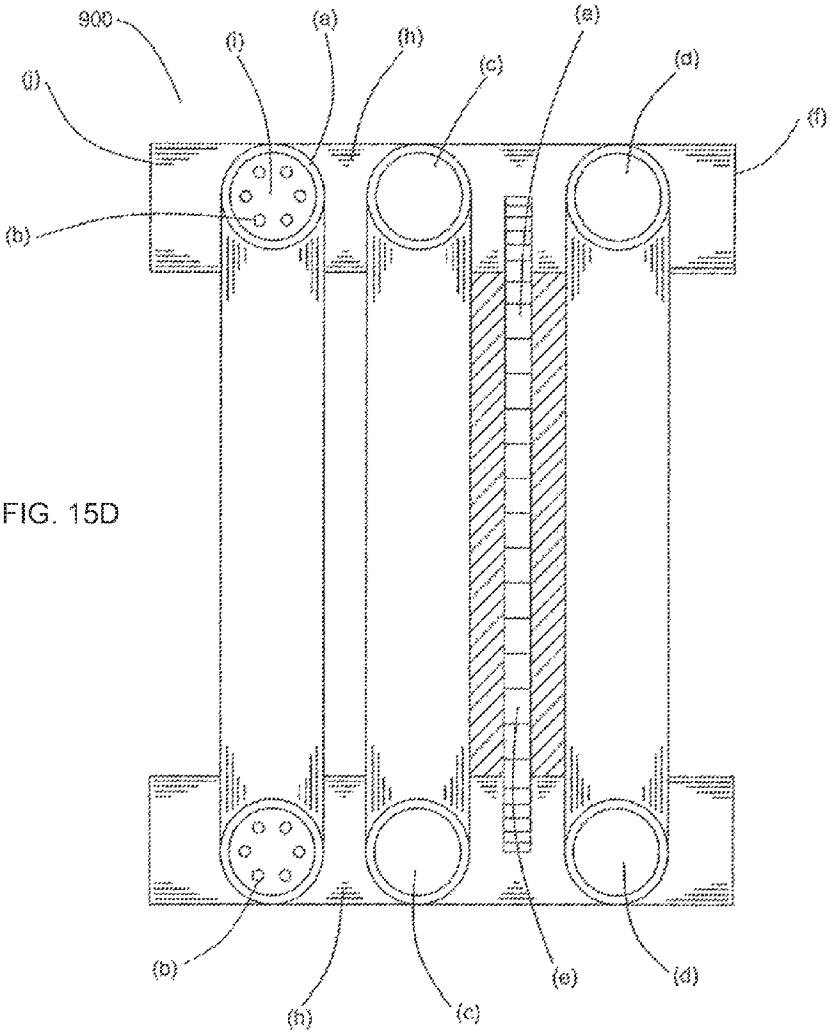

FIG. 15*d* is a sectional side view of a further buoyancy control system.

Figure 1B:
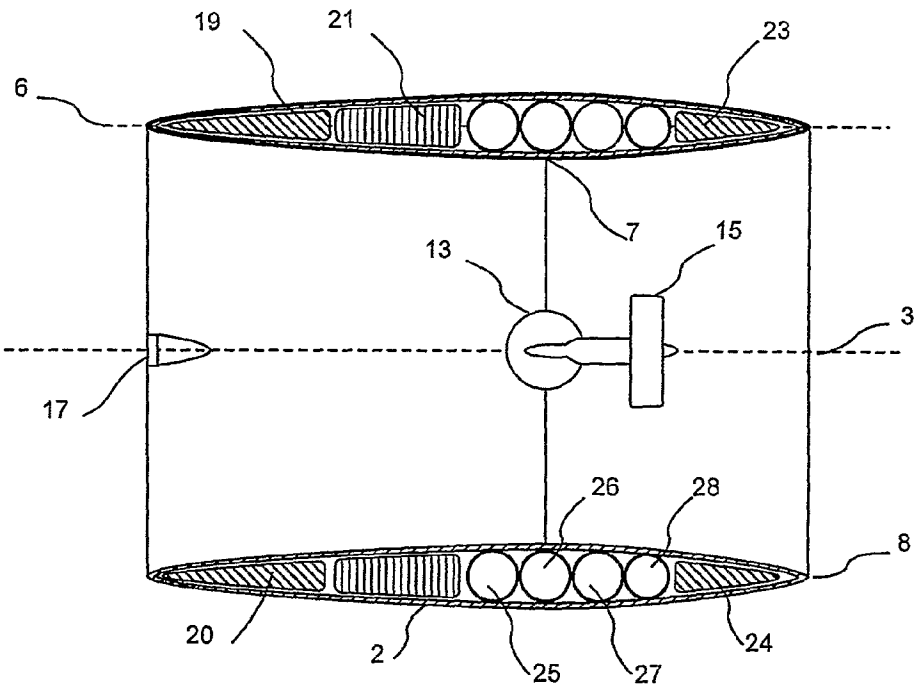
Figure 1A:
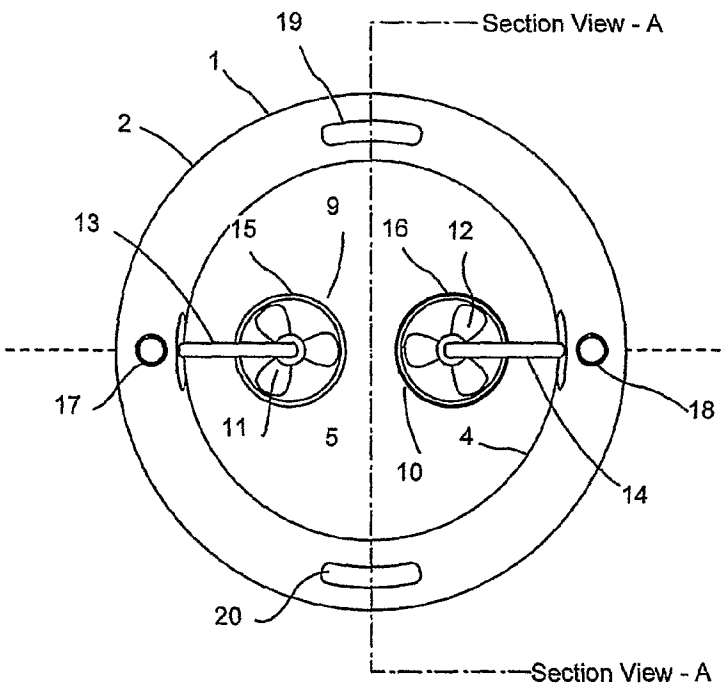

Referring to FIGS. 1*a* and 1*b*, a submersible vehicle 1 has an outer hull 2 which is evolved from a laminar flow hydrofoil profile (shown in FIG. 1*b*) as a body of revolution around a hull axis 3. Thus the outer hull 2 appears annular when viewed along the hull axis as shown in FIG. 1*a*. An inner wall 4 of the annulus defines a duct 5 which is open fore and aft so that when the vehicle is submerged in water or any other liquid, the water floods the duct and flows through the duct as the vehicle moves through the water, generating hydrodynamic lift.

As shown in FIG. 1*b*, the hydrofoil profile tapers outwardly gradually from a narrow bow end 6 to a widest point 7, then tapers inwardly more rapidly to a stern end 8. In this particular embodiment the widest point 7 is positioned approximately two-thirds of the distance between the bow and stern ends. The particular hydrofoil section may be modified in variants of this and other vehicles so as to modify the coefficients of lift, drag and pitch moment in accordance with a particular range of flow regimes as determined by the appropriate range of Reynolds numbers that may be valid within a variety of applications.

Figure 2B:
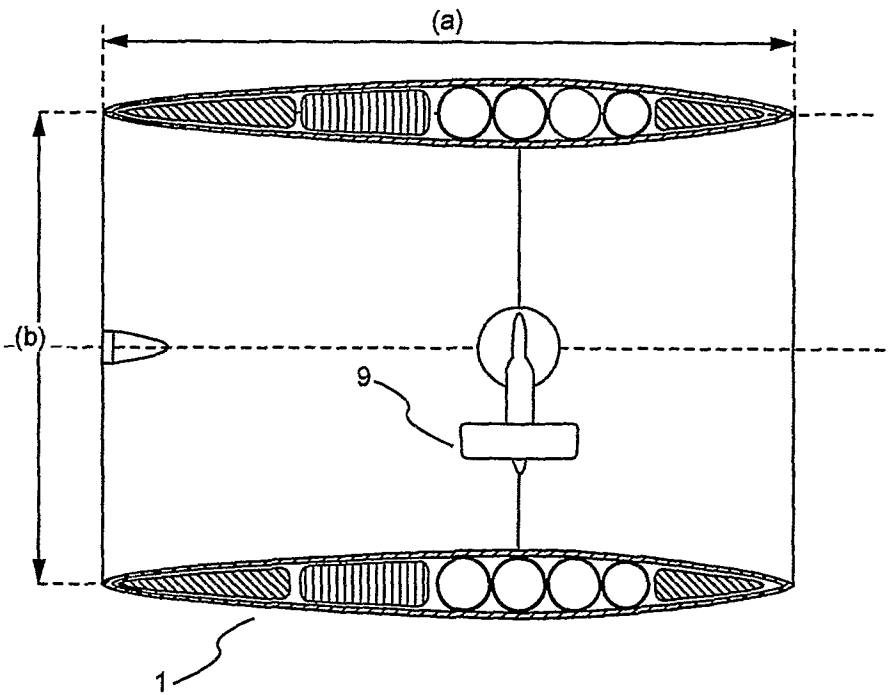
Figure 2A:
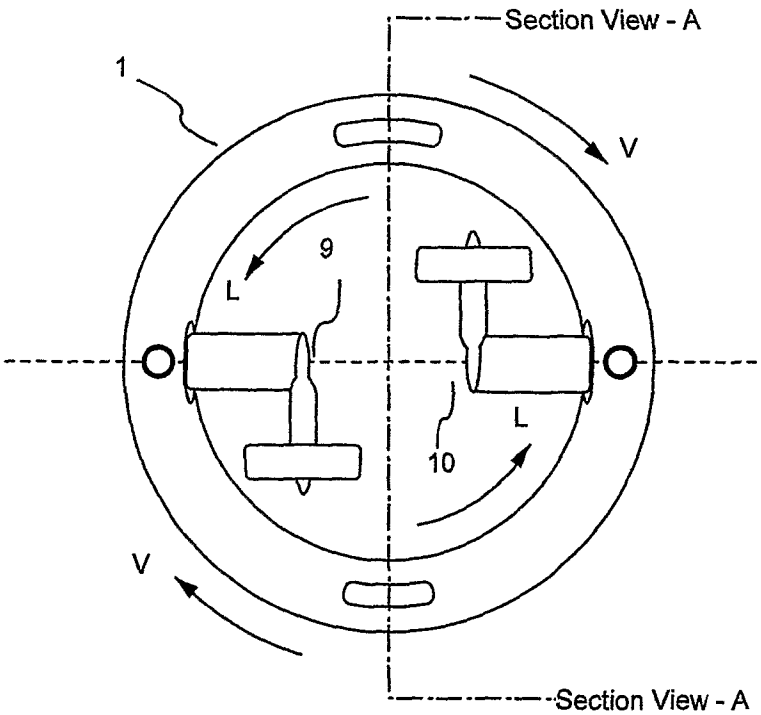

A pair of propulsors 9,10 are mounted symmetrically on opposite sides of the hull axis. The propulsors comprise propellers 11,12 which are mounted on L-shaped support shafts 13,14 which in turn are mounted to the hull in line with the widest point 7 as shown in FIG. 1*b*. The propellers are mounted within shrouds 15,16 in such a way that their efficiency is increased. Each L-shaped shaft is pivotally mounted to the hull so that it can rotate by 360 degrees relative to the hull about an axis parallel to the pitch axis of the vehicle, thus providing thrust-vectored propulsion. Both the shroud and L-shaped shaft have a hydrofoil section using a ratio between chord length and height similar to that described for the outer hull. Thus for example the propulsors 8,9 can be rotated between the co-directed configuration shown in FIGS. 1*a* and 1*b*, in which they provide a thrust force to propel the vehicle forward and along the hull axis, to the contra-directed configuration shown in FIGS. 2*a* and 2*b*, in which they cause the vehicle to roll continuously around the hull axis. Arrows V in FIG. 2*a* illustrate movement of the vehicle, and arrows L in FIG. 2*a* illustrate flow of the liquid. It follows therefore that this particular embodiment uses four motors within its propulsion system: two brushless DC electric motors to drive the propellers, and two DC electric motors to drive the L-shaped support shafts upon which the propeller motors are mounted, where a mechanical worm drive gear reduction mechanism is used to transfer drive and loads between the motor and the L-shaped shafts. Alternative motor types such as stepper motors may be used for the latter scheme, so long as operating loads are consistent with the rating of the motors.

To provide for a minimum of open loop pitch or yaw stability the vehicle's centre of gravity (CofG) is located forward of the centre of hydrodynamic pressure, where greater stability is achieved by greater separation between these centres. However, the precise location is not critical since additional stability may be provided by a closed loop attitude control system (not shown) that may be combined with the vehicle's propulsion system. In such circumstances stability may be sacrificed for agility by operation of the vehicle with its CofG at or behind the centre of hydrodynamic pressure. Similarly the position of the propulsors may be adjusted either forward towards the bow, or rearwards toward the stern, wherein vehicle dynamics may be adjusted accordingly.

Such an attitude control system includes (i) a device that measures linear acceleration in three orthogonal axes; and (ii) a device that measures angular acceleration in three orthogonal axes; and (iii) a device that measures orientation in two or three orthogonal axes; and (iv) a device that combines the signals from these devices and calculates demand signals that stimulate the aforementioned propulsion system, in accordance with the particular vehicle dynamic motion or stability desired at that time. The orientation device may include a gravity sensor, or a sensor that detects the earth's magnetic field vector, or both. The vehicle may also include a navigation system that estimates the position of the vehicle at any particular time with respect to some initial reference position. A preferred embodiment of such a navigation system includes a processing device that operates on data provided by the attitude control system described above, and also upon other optional data where specific sensors that provide such data may also be included within the vehicle for navigation purposes. Such sensors may include (i) a Geostationary Positioning Satellite (GPS) receiver device, and (ii) one or more acoustic transponders or communication devices. The GPS device is used to derive an estimate of the vehicle's position in latitude, longitude and elevation when surfaced. The acoustic transponder or communications device transmits and receives acoustic signals in order to establish its position relative to one or more corresponding transponder or communications devices located within the local liquid medium. In a preferred embodiment the processing device includes a specific algorithm described as a kalman filter that estimates the relative or absolute position of the vehicle based upon the variable data provided from the sensor devices of the attitude control and navigation systems.

In this particular embodiment the vehicle is designed with a small degree of positive buoyancy. The centre of buoyancy (CofB) may be positioned anywhere between a minimum where the CofB lies coincident with the centre of gravity, and a maximum where the CofB lies within the volume of an inverted cone above the CofG, and where the apex of the cone adjoins the CofG and where the base of the cone is subtended by the upper part of the annular hull.

In a particular embodiment the cone is inclined such that no part of its volume lies rear of the vertical plane that bisects the vehicle's axis and coincides with the CofG. When the CofB lies within this cone and is separated from the CofG, the vehicle will adopt a positive pitch under static conditions and therefore may glide from depth to the surface under forces derived only from the combination of positive buoyancy and hydrodynamic lift from the annular hull, and where some useful lateral distance of travel is gained by the vehicle's shallow glide path.

This allows for opportunistic conservation of energy within a vehicle's battery store by re-use of gravitational forces within its mission cycle. The glide path of the vehicle may also be improved by adopting propellers (not shown) that may be folded to lie parallel to the hull axis when not in use, or by omission of the propeller shrouds, in which cases vehicle drag will be further minimized.

The vehicle may also include solar energy cells (not shown) arranged around the outer body of the hull, where once again the annular hull provides an efficient implementation since its outer surface area is relatively large when compared to a cylindrical vehicle of similar mass. In such an embodiment the solar cells are connected electrically to a charging circuit that replenishes the energy stored within rechargeable cells located within the battery stores. This allows for planned and opportunistic replenishment of vehicle energy stores using solar energy when the vehicle is operating or stationary at or near the sea surface.

In this embodiment the CofB may be fixed at some static location within the aforementioned volumetric cone, or the CofB may be dynamically adjusted by a control mechanism to positions around the cone. In either case the CofB is controlled by the location of one or more positively buoyant ballast elements located within a toroidal section of the annular hull. In the embodiment where two ballast elements are used, the elements may be co-located within the toroid, in which case the vehicle's static buoyancy will be a maximum; or the two ballast elements may be located around the toroid in such a manner that the vehicle's CofB and CofG both lie on the hull axis, in which case the vehicle's static stability will be zero.

Therefore the vehicle may use its propulsion system to induce spin around its hull axis, and the vehicle may adjust the position of its CofB in relation to its CofG. The vehicle may therefore adapt its dynamic motion when traveling without spin, when maximal separation between CofB and CofG is desirable. However the vehicle may also adapt its dynamic motion when spin is induced, either with or without motion along the axis of the hull, when minimal separation relative to the hull axis between CofG and CofB is desirable in the event that one should wish to minimize eccentricity in roll.

The thrust vectored propulsors provide the means for motion along the hull axis, either forward or in reverse, and spin or roll around the hull axis, and pitch or yaw about the vehicle's CofG. As described earlier it is clear that the two propulsors may be contra-directed in order to induce vehicle roll. The two propulsors may also be co-directed. For instance when both are directed down so that their thrust vectors lies above the CofG, then the vehicle will pitch nose down. Similarly when the two propulsors are directed up so that their thrust vector lies below the CofG, then the vehicle will pitch nose up. It is also clear that varying degrees of propulsor pitch in relation to the vehicle and each other may be used to achieve vehicle pitch, roll and yaw. Yaw may also be induced by differential thrust application when differential propeller revolution rates are adopted. Thus it can be seen that the vehicle is able to dive, turn, roll and surface under its own autonomous control.

The vehicle can be driven in a special way when the vehicle is spinning and when the position of the CofG is co-aligned with the propulsor axis of rotation. Referring to FIG. 2*b*, if we define a vertical direction being vertical on the page, then in the position shown in FIG. 1*a* the vehicle is at a roll angle of 0 degrees with the propulsor 9 directed up and the propulser 10 directed down. If downwards movement is required, then the propulsor 9 is pulsed on when it the vehicle is between 350 degrees and 10 degrees (or some other limited arc in which the propulsor 9 is directed generally upwards) and the propeller 10 is pulsed on when the vehicle is between 170 degrees and 190 degrees (or some other limited arc in which the propulsor 10 is directed generally upwards). The vehicle integrates the thrust vector around the arc, and experiences a linear acceleration that induces travel normal to the hull axis (in this case downwards). This enables the spinning vehicle to be precisely moved in a plane that lies normal to the hull axis.

It is therefore clear that the vehicle has a high degree of manouevrability, since its thrust vectored propulsion may be arranged for high turn rates under dynamic control. It is also clear that the vehicle has a high degree of stability. In the first instance when motion is along the axis of the hull then relatively high speeds may be achieved with contra-rotating propellers that cancel induced torque, while contra-directed propulsors provide for further roll stability. In the second instance when spin motion around the hull axis is induced, then angular momentum is increased and once again the stability of the vehicle is increased, where this may be measured as a reduction in vehicle attitude or position errors when subject to external forces.

The bow of the vehicle carries a pair of video cameras 17,18 for collision avoidance and imaging applications. The relatively large diameter of the hull enables the cameras to be well spaced apart, thus providing a long stereoscopic baseline that provides for accurate range estimation by measurement of parallax between objects located within both camera fields of view. A sonar transmitter 19 and a sonar receiver 20 are provided for sonar imaging and sensing. Again, the wide baseline is an advantage. The outer hull 2 contains an interior space which can be seen in FIG. 1*a*. This outer hull is preferentially manufactured from a stiff composite material using glass or carbon fibre filaments laminated alternately between layers of epoxy resin. Alternatively a cheaper, less resilient hull may be moulded from a suitable hard polymer such as polyurethane or high density polyethylene. It is also possible to manufacture the outer hull from aluminium, should the hull be pressurised. The interior space may be flooded by means of small perforations (not shown) in the outer hull, or may be pressurized. The interior space houses a pair of battery packs 21,22, a pair of stern sensors 23,24, and four toroidal pressure vessels 25-28 spaced apart along the hull axis. The pressure vessels contain the vehicle electronics, some propulsion subsystem elements and other items, and are joined by axial struts (not shown). In this particular embodiment the toroidal pressure vessels are preferentially manufactured from stiff composites using either glass or carbon fibre filaments wound helically around the toroid and alternately laminated between layers of epoxy resin. Alternatively the toroidal pressure vessels may be manufactured from a suitable grade of metal such as aluminium, stainless or galvanized steel, or titanium.

The length of the hull along the hull axis corresponds to the chord of the hydrofoil section, and this is indicated at (a) in FIG. 2*a*, while the diameter or span across the duct at its two ends is indicated at (b). The aspect ratio (AR) of the hull is described as follows:

$$AR=2B^2/S$$

where B is the span of the hull (defined by the maximum outer diameter of the hull) and where S is the projected area of the hull.

If we take the span B as being approximately equal to (b), and the area S as being approximately equal to (b)×(a), then AR is approximately 2 (b)/(a). In the vehicle of FIG. 2*b*, the AR is approximately 1.42, although this number may be modified in other embodiments where the application may demand other ratios. It is evident that the vehicle form may be adjusted by simple variation of its toroidal diameter to reflect narrow vehicles where aspect ratio is low, or to reflect broad vehicles where aspect ratio is high. In either case specific advantages may be gained under certain circumstances, since relatively high coefficients of lift may be achieved using a toroidal form with low aspect ratio, while optimal glide slope ratios, or equivalent ratios of lift over drag may be achieved using a toroidal form with high aspect ratio.

The outer hull is designed to minimize its drag coefficient within the fluid flow regime determined by the range of Reynolds numbers that describe the operation of the vehicle within particular scenarios. The outer hull includes an underlayer (shown in FIG. 1*b* with cross hatching), and an outer skin layer (not shown).

Figure 3A:
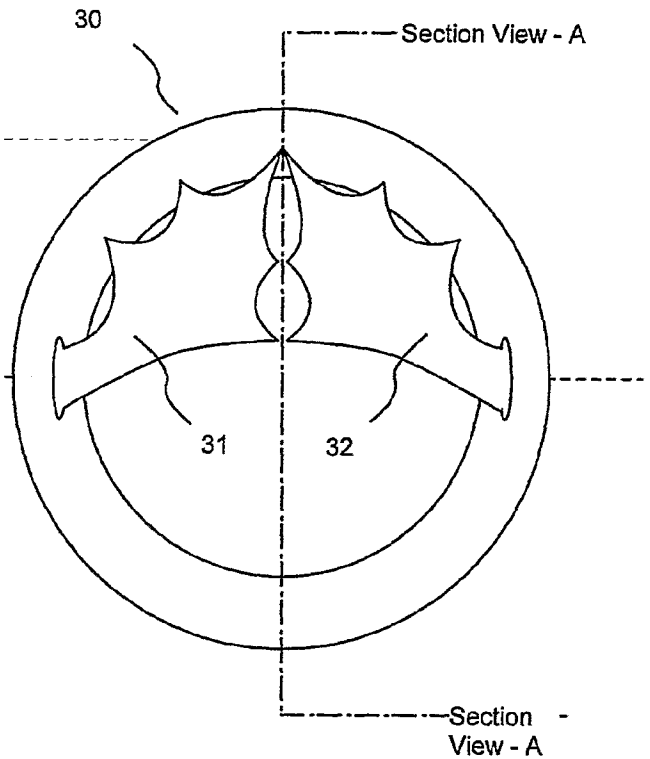
Figure 3B:
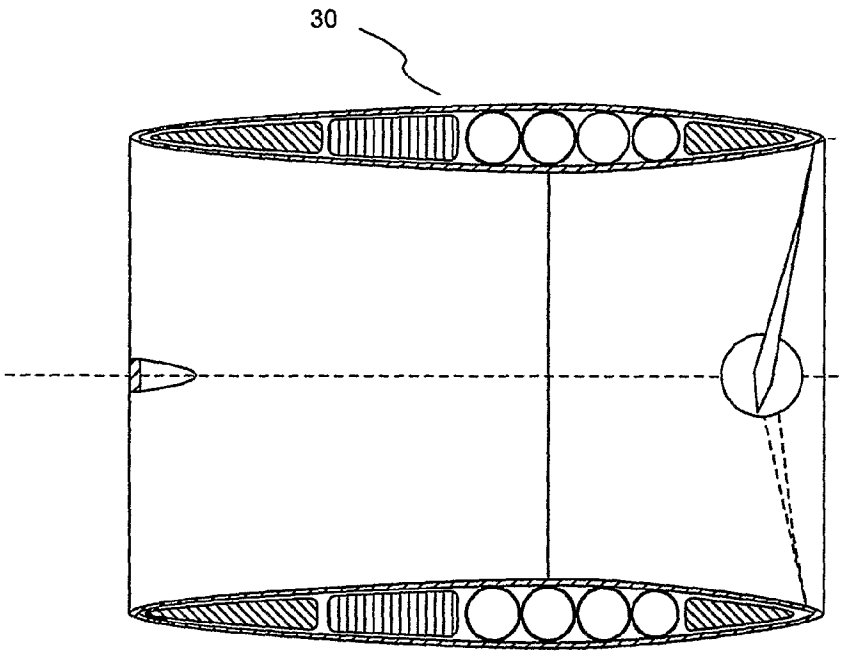

A second vehicle 30 is shown in FIGS. 3*a* and 3*b*. The vehicle is identical to the vehicle 1, but employs a bio-mimetic fin twin thrust vector propulsion system instead of a propeller twin thrust vector propulsion system. In this case the propulsion system consists of a pair of fins 31,32 which are pivotally mounted to the outer hull towards the stern end, and can rotate by just under 180 degrees between a first (stow) position shown in solid line in FIGS. 3*a* and 3*b*, and a second position shown in dashed line in FIG. 3*b*. Each of the fins is rotated by a separate electric DC brushless motor and mechanical gear reduction mechanism which preferentially would include a helical worm drive (not shown), and can be driven in a number of modes. In this configuration the fins are manufactured from a particular grade of polyurethane to provide for some flexure while under load in reciprocating motion, where such flexure serves to direct a propulsive wave vortex rearwards from each fin more efficiently.

In one mode the fins are reciprocated out of phase to generate a paddling motion that drives the vehicle forwards along the hull axis. In another mode, the fins are driven in a reciprocating manner but this time in phase with each other again to drive the vehicle forwards along the hull axis.

In another mode the fins are driven in a reciprocating manner but this time with the centres of their reciprocating arcs displaced above and below the horizontal plane described by the hull axis and the fin pivot axis, and in so doing to drive the vehicle forward and induce roll, where roll may be in either direction depending on the relative displacement of the reciprocating fins.

In another mode the fins are driven in a reciprocating manner but this time in phase with each other, and once again with the centre of the reciprocating arc displaced above or below the axial-pivotal plane described earlier. This mode propels the vehicle forward but also causes pitch rotation about the CofG, and so may be used for vehicle dive or rise. When used in combination with the vehicle's roll mode, then this mode will couple and produce vehicle yaw.

This bio-mimetic propulsion design allows for continuously variable frequency and magnitude of excitation signals to each fin propulsor, and also for continuously variable selection of reciprocating centres of fin arcs, for either fin, and also for continuously variable phasing between fins. This design achieves, therefore, good propulsive efficiency at slow speeds, and also good propulsive efficiency at high speed.

Another embodiment of this scheme uses similar reciprocating fins, but in this particular design an additional three knuckle hinges are included approximately half way between the fin pivot and the fin tail. These knuckle hinges are manufactured from stainless steel and driven in a reciprocating manner with careful phasing in relation to excitation provided at the fin pivot. This design produces a traveling wave that commences at the fin pivot with amplitude x at the knuckle hinge, which then proceeds to the fin tail with amplitude y, and where y is greater than x. Using this design the modes of operation described earlier are replicated, as are their advantages in operation, but herein the propulsive efficiency is improved by careful phasing of the pivot and knuckle hinge excitation drive signals in order to achieve a traveling propulsive wave.

Figure 4A:
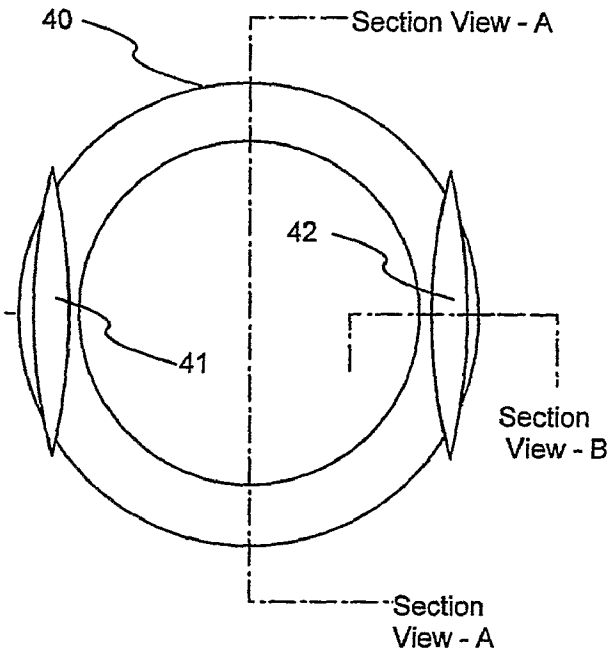
Figure 4B:
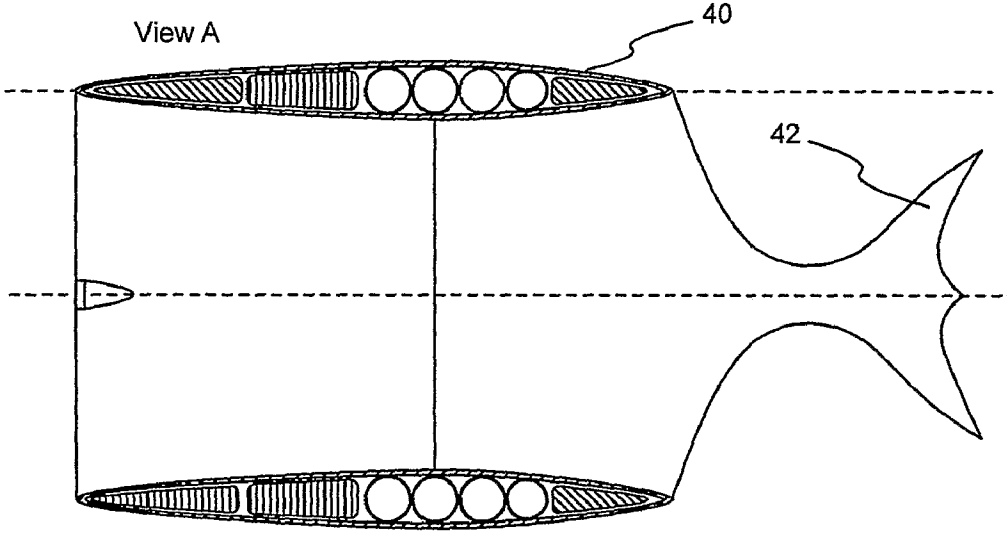
Figure 4C:
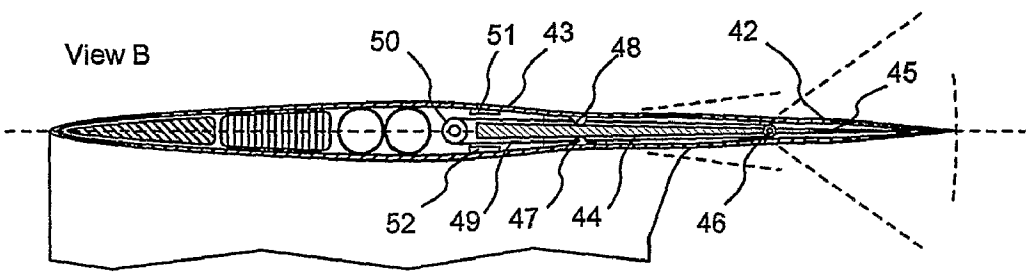

A third propelled vehicle 40 is shown in FIGS. 4*a*-*c*. The vehicle is similar to the vehicle shown in FIGS. 3*a* and 3*b*, and also employs a bio-mimetic fin twin thrust vector propulsion system. A pair of axi-symmetric fins 41, 42 are mounted to the stern of, and conformal with the annular hull. The fins are identical and one 42 is shown in cross section in FIG. 4*c*. The skin layer of the outer hull terminates at 43, but the underlayer (which has a degree of flexibility) extends around the fin, where the underlayer comprises an elastomeric material such as polyurethane. The fin contains a structural frame comprising a proximal plate 44 and a distal plate 45 joined at a pivot 46. A pair of ridges 47,48 engage opposite sides of the distal plate part of the way along its length. A line 49 is attached at both ends to the pivot 46, and passes over a driven pulley 50. Driving the pulley 50 causes the proximal plate 44 to rotate about the ridges 47,48, and the distal plates to rotate about the pivot 46, as shown in dashed lines. By reciprocating the pulley 50, the fin 42 also reciprocates. Two further lines (not shown) are used to control the upper and lower fin tail corners, so that the fin tail corners may be steered independently within each propulsor, and independently of either propulsor, in such a way that positive or negative hydrofoil wing twist is effectively imparted at any fin tip using this method. This method provides the vehicle with substantial agility.

An alternative embodiment of this propulsor drive mechanism uses two electromagnets 51, 52 located on either side of the distal plate, which are stimulated by injection of electric current around coils located at the electromagnets, so that alternate phasing of such signals in either electromagnet induces a reciprocating action in the proximal plate. A control device (not shown) controls the excitation of the electromagnets, and also controls the excitation of the motor that drives the pulley 50 and distal plate with a similar reciprocating action, although the relative phasing of the reciprocating proximal and distal plates is carefully maintained by the control device so that a travelling propulsive wave is delivered by the propulsor. It is clear that other variants may be implemented in this scheme, including the provision of rare earth or similar magnets on the proximal plate, and reciprocal arrangements where the positions of magnets and electromagnets are reversed.

A primary difference in this embodiment of bio-mimetic propulsion in combination with the annular hull is that fin strokes may be executed axi-symmetrically, which increases the propulsive efficiency of the vehicle. Once again the propulsion modes described earlier may be replicated with this design with the exception that vehicle roll is induced by asymmetric drive of fin tail corners. The plates may be rigid, or they may be designed to flex, so long as flexure is accounted for in the phasing of excitation signals. Once again efficient propulsion is achieved by excitation and phasing drive of proximal and distal plates and tail fin corner lines such that a reciprocal pair of axi-symmetric traveling propulsive waves are transferred from the base of each fin to each fin tail.

As described earlier, this design of bio-mimetic propulsion in combination with the annular hull delivers many degrees of freedom in tuning its propulsion efficiency.

It should be clear that the number of fin propulsors associated with the annular hull as shown in FIGS. 4*a*, 4*b* and 4*c* may easily be extended to some larger number n, where in the limiting case the fin propulsors merge around the tail circumference of the vehicle to form a continuous and conformal, flexible, annular bio-mimetic propulsor.

A particular embodiment of such a conformal, flexible, annular bio-mimetic propulsor is described as follows. The drive assemblies described above for the axi-symmetric dual fin propulsor vehicle are replicated around the rear of the annulus so that n=10, such that the distal and proximal plates are housed within a conformal elastic polyurethane jacket that attaches to the rear of the vehicle's annulus. No additional lines for tail corner fins are included, since these become redundant when the fin propulsor is fully evolved into a flexible and conformal annulus.

The proximal and distal plates are driven as described earlier such that a progressive and propulsive, continuous and axi-symmetric traveling wave is excited from the base of the flexible annulus to its tail so as to drive the vehicle forward along its hull axis. Control of pitch and yaw become trivial in this embodiment since full circumferential control of the flexible annulus is possible, and excitation of proximal and distal plates in an independent manner may be done.

Figure 5A:
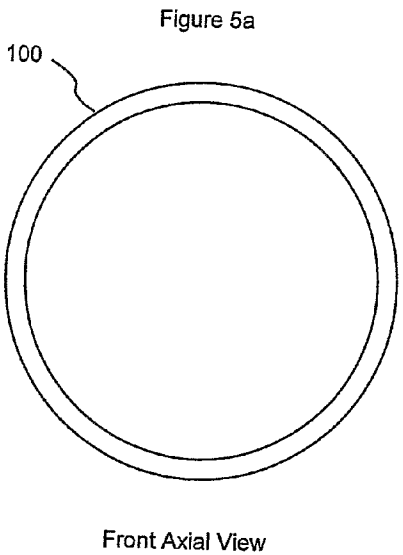
Figure 5B:
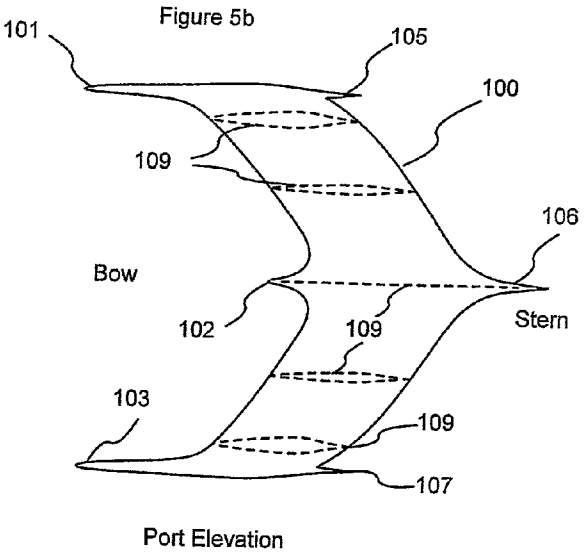
Figure 5C:
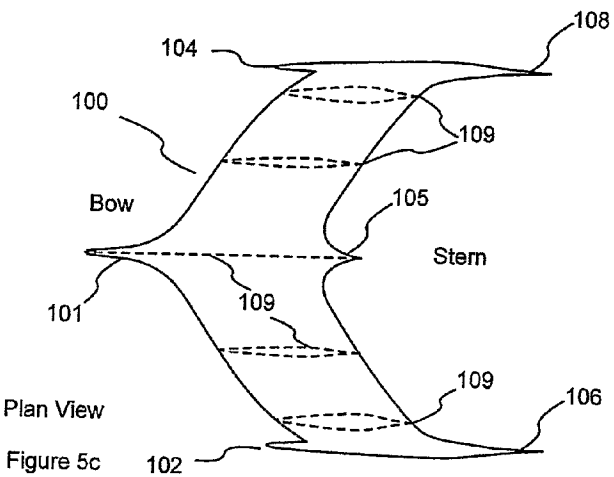

A glider vehicle 100 is shown in FIGS. 5*a*-*c*. The hull of the vehicle has an annular construction as shown in FIG. 5*a*, and adopts a swept-back shape to minimize vehicle drag; to reduce residual energy released into wake vortices; to provide for pitch and yaw stability; and to provide a novel mechanism for attitude control. FIG. 5*b* is a view of the vehicle's port elevation, while 5*c* describes a plan view of the vehicle with dashed lines indicating the shape of the hydrofoil profile. The outer hull uses similar construction, and houses various sensors, battery packs, and pressure vessels in common with the vehicles shown in FIGS. 1-4, but for clarity these are not shown.

The hull has four bow vertices 101-104 and four stern vertices 105-108 which are separated by 90 degrees around the periphery of the hull.

A buoyancy engine (not shown) is housed within the outer hull and can be driven cyclically so that the vehicle alternately sinks and rises. By careful adjustment of the relative position of the CofB and CofG the vehicle may be inclined as it sinks and rises, and so lift forces are generated by the outer hull shape so as to impart a component of forward motion. This enables the vehicle 100 to operate as a buoyancy powered glider, which may be used singly or in self-monitoring fleets and be programmed to sample large areas of ocean or seabed or coastline without intervention from local support teams.

In this particular embodiment the vehicle adopts a very low energy configuration, since hydrodynamic drag is minimized, and continuous motor propulsion is not provided since its motive force is derived from a buoyancy engine that changes its state only twice during each dive and rise cycle, and so electrical energy consumption is also minimized.

Whereas classical ocean gliders modify their buoyancy and adjust the position of mass along their hull axis, this particular embodiment maintains fixed mass and modifies its buoyancy and CofB location by adjustment of its buoyancy engine along a ring (not shown) that sits within the vehicle's annular hull and follows the hull's swept back shape. As the vehicle moves up, the buoyancy engine is located adjacent to the upper bow fin 101, so that the CofB lies forward of the CofG, resulting in a "nose-up" configuration. Motion of the buoyancy engine to port or starboard around the hull under motor control will both roll the vehicle around its hull axis and also move the CofB aft of the CofG, at which point the vehicle will be inclined "nose-down". The buoyancy engine is then made negatively buoyant and the vehicle will glide down into the ocean. At some pre-determined time or depth the buoyancy engine traverses around its ring and the vehicle commences rotation around its hull axis, and the CofB moves forwards above the hull axis through 90° in hull rotation, at which point the vehicle will be inclined nose up, buoyancy will become positive and the vehicle will glide towards the ocean surface.

The vehicle may also include one or more devices that will extract energy from the thermocline through dive to depth and climb to the sea surface, where temperature gradients of 20° C. or more may be anticipated in many oceans between 0 and 600 m in depth, and where 75% of ocean volume has temperatures of 4° C. or less, while ocean surface temperatures may exceed 30° C. or more.

One such energy harvesting device is a particular embodiment of a buoyancy control system 900 as described in FIG. 15*a* or 15*d* wherein a temperature sensitive phase change material (PCM), (i) is housed within a chamber (a) that forms part of a toroidal pressure vessel, and where a number of toroidal aluminium tubes (b) also reside within this chamber. The wall of the chamber is also made of aluminium, and is enclosed within an insulating composite structural layer such as syntactic foam or neoprene and epoxy resin combined with glass or carbon fibre filament. where such filaments would be helically wound around the chamber's toroidal form, and where such materials maintain low thermal conductivity between the inner and outer surfaces. Two other insulating toroidal chambers (c), (d) are included, where such chambers may be separate toroids or may be a part of the former toroid, where its structure may be divided into three or more sectors around its toroidal axis.

Chamber (a) interfaces with a port that opens to the external sea water, so that sea water may enter a section of this chamber which also includes a flexible low thermal conductivity membrane or piston seal interface to maintain an insulating physical barrier between chamber (a) and the seawater. Chamber (a) also interfaces with a high pressure gas chamber (j), which also connects to the seawater via two flexible membranes separated by a volume of liquid, and by another valve. Chamber (c) interfaces with two ports and two valves (h) that connect to the aluminium tubes within chamber (a). The toroidal pressure vessel may also include an optional low pressure gas chamber (k) with a flexible membrane assembly and an interface port to the external liquid. Chamber (d) also interfaces with two ports and two valves (h) that connect to the same aluminium tubes, and may also include an array of thermoelectric semiconductor (TES) peltier effect devices (e), where either side of such devices would maintain a low thermal resistance path to the external seawater or the internal fluid. Chambers (c) and (d) also include ports and valves that open to the sea water.

A control device (f) and one or more fluid pumps (g) are used to open and control the valves and ports in sequence with the operation of the vehicle. Chamber (c) is filled or replenished with warm water when near the surface, while chamber (d) is filled or replenished with cold seawater when deep. The control device (f) may also be used to stimulate the TES (e) device with a potential difference applied to its two semiconductor junctions in order to lower the temperature of the fluid in chamber (d) during initialization of the vehicle, when operating near the sea surface. Alternatively a simple ballast device may be used to initiate the vehicle's first dive cycle instead.

The control device (f) operates the ports, valves and pump when close to the liquid surface to pressurize the dry gas (l) using the expanded volume of the phase change material (i) which is exposed to the warm surface temperatures via tubes (b) and the warm reservoir (c) and the external liquid. After pressurization of the chamber (j) and gas (l) its valves are closed so that energy is stored. The vehicle may descend using quiescent negative buoyancy, or using a transient ballast device, or by modulation of its density by exposure of the PCM (i) to low temperatures using the control device (f) and the reservoir chamber (d) or TES (e) or combinations thereof. In preferred embodiments the reservoirs (c), (d) and tubes (b) and pump assist in circulation of the seawater in order to minimize inefficiency due to local temperature gradients. The resulting drop in temperature around the PCM is maintained efficiently by close coupling of the aluminium tubes (b) within the PCM volume, which causes a phase change from liquid to solid in the PCM and a corresponding reduction in volume which increases the density of the vehicle so that it becomes heavier than seawater and therefore descends.

When a pre-determined depth is achieved the control device (f) operates the ports, valve and pump to release the pressurized gas (l) so as to move and fill a flexible membrane and displace a certain volume of external liquid, so that the density of the vehicle becomes positive compared to the external liquid, so that the vehicle commences its ascent. During ascent the control device (f) operates the ports, valves and pump to transfer warm sea water from chamber (c) into chamber (a) via tubes (b), and once again to circulate the seawater between these two chambers. The resulting increase in temperature around the PCM causes a phase transition from solid to liquid, and a corresponding increase in volume which lowers the density of the vehicle further so that its ascent may be accelerated.

A number of phase change materials may be utilized within such a device, such as paraffins, fatty acids or salt hydrates where the material or the particular mixture of materials would be chosen so that their particular phase change would occur within the band of temperatures to be encountered within the designated thermocline, and more typically so that material phase change between solid and liquid would occur between 8 C and 16 C, although the precise range would be selected to match the anticipated depth profiles and local ocean temperatures.

This invention secures advantage over alternative buoyancy control devices through integration of the phase change material within a toroidal pressure vessel, where local geometries and materials combine to provide a highly efficient device for modulation of vehicle density during transit through the thermocline.

A further embodiment of this energy harvesting device extracts additional energy from the thermocline in order to improve the operational efficiency and endurance of the vehicle. In this alternative embodiment the TES (e) located at chamber (d) and control device (f) combine to generate a potential difference between the two semiconductor junctions of the TES when a temperature differential is maintained between its opposite sides, which of course is achieved sequentially during successive dive and rise cycles. This potential difference is routed to an array of super-capacitors and then to the vehicle battery store via some high frequency switching DC to DC converter that minimizes its electrical losses and achieves a transfer efficiency in excess of 90%. This additional energy harvesting device may also be modified such that the TES occupies a barrier between cold chamber (d) and warm chamber (c), as shown in FIGS. 15*a* and 15*d*.

The vehicle may instead accommodate one of many alternative buoyancy control devices, including pressurized gas and tank systems, or hydraulic pump, or electric motor drive and piston valve systems where stored energy is used to physically evacuate the seawater from a prescribed volume within the vehicle.

A further advantage of this buoyancy control system is extensibility, where the toroidal form may be evolved to larger diameters, and where toroids may be used in groups as described in FIG. 15*d*. A further embodiment of this scheme evolves the toroidal buoyancy control device as shown in FIG. 15*a* into a helix as described in FIGS. 15*b* and 15*c*. This solution maintains the toroidal form and basic architecture but linearly extends its capacity, which serves to provide for greater displacement volumes within an efficient structure which would otherwise be cumbersome and difficult within large underwater vehicles.

Although the embodiment described above uses only buoyancy as its source of motive propulsion, it is clear that other embodiments may be disclosed that augment the low energy vehicle with bio-mimetic fin or circumferential propulsion devices as described for the vehicles 30,40 above. Also the low energy vehicle described herein may be augmented by propeller and propulsor devices as disclosed in vehicle 1 above.

In another embodiment of the low energy glider vehicle, the buoyancy engine may be fixed, and mass is moved instead around a pressure vessel under motor control, to effectively move the CofG forward or rearwards and consequently to induce pitch up or pitch down attitudes. In a further embodiment, both the mass and the buoyancy engine may be moved around the ring.

The vehicle may also be augmented by solar energy cells as described earlier for other vehicles, so as to replenish its internal energy store when close to the sea surface and therefore to extend its mission period at sea.

It is also clear that the vehicle may be modified to implement ocean gliders of varying size. The annular construction is advantageous in this regard and offers structural resilience and so vehicles of this form may be constructed with spans of 30 m or 60 m or more.

Figures 6A, 6B, 7:
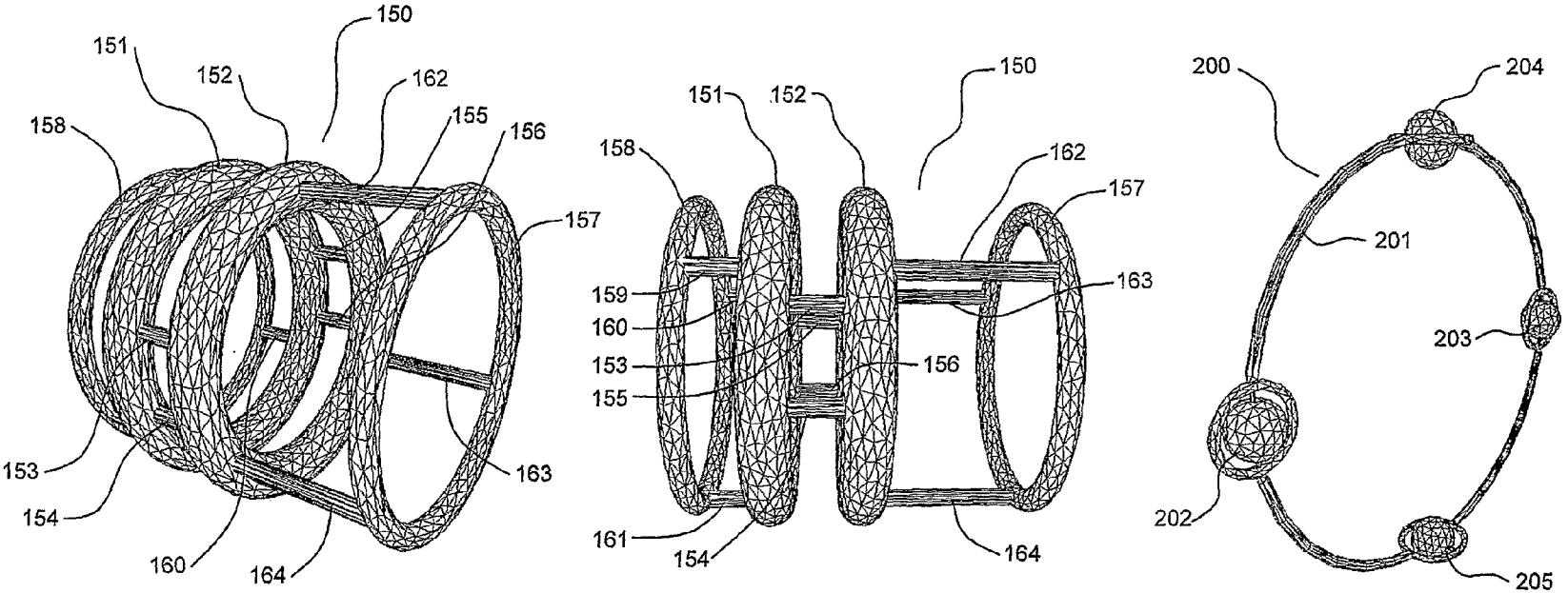
FIG. 7 is a perspective view of an alternative attitude control system.

FIGS. 6*a* and 6*b* are perspective and side views of an alternative pressure vessel 150, similar to the pressure vessel shown in FIGS. 1*a* and 1*b*. A pair of relatively large toroidal pressure vessels 151,152 are connected to each other by axial struts 153-156. A pair of relatively small toroidal pressure vessels 157,158 are positioned fore and aft of the large pressure vessels 151,152, and connected by axial struts 159-164. The axial struts may themselves be pressure vessels, so that the entire structure provides a single continuous vessel, or the axial struts may be solid structural members, in which case the toroids form four separate partitioned pressure vessels. The toroidal shape enables deep dive without excessive mass or cost.

FIG. 7 is a perspective view of an inertial attitude control system 200. An annular supporting frame 201 is mounted inside one of the toroidal pressure vessels. The system 200 is illustrated with a "flat" frame, suitable to be fitted in a correspondingly "flat" toroidal pressure vessel, for instance in one of the vessels 1, 30 or 40. However the system may be adapted to fit into one of the "swept" vessel configurations described herein by suitable adjustment of the shape of the frame 200.

A first pair of masses 202,203 are mounted on the frame by respective axes which lie perpendicular to the hull axis. A second pair of masses 204,205 are mounted on the frame by respective axes which lie parallel to the hull axis. Each mass can be rotated independently by a respective motor (not shown) about its respective axis. By accelerating the masses 202,203, an equal and opposite angular acceleration is imparted to the vehicle, giving pitch control. By accelerating the masses 204,205, an equal and opposite angular acceleration is imparted to the vehicle, giving roll control in the configuration of FIG. 7. The combination of pitch and roll provides yaw control.

Figure 8:
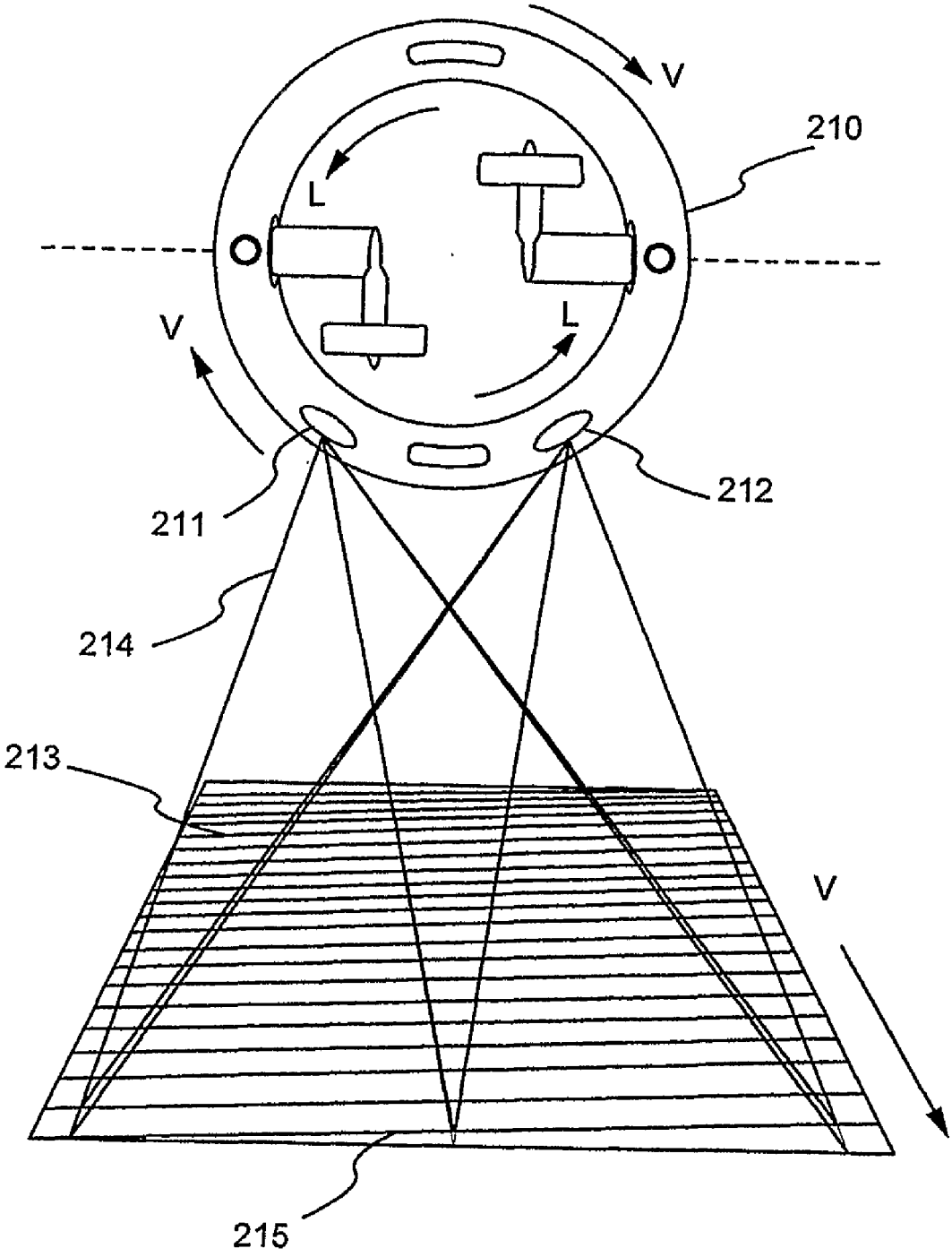
FIG. 8 is a front view of a fourth propelled vehicle in use.

FIG. 8 shows a vehicle 210 which is a variant of the first vehicle 1. The vehicle 210 is identical to the vehicle 1, but further incorporates a sonic transmitter 211 and sensor 212. A perspective view of a surface 213 is shown below the vehicle. The surface 213 is parallel to the hull axis. The vehicle is translated in the direction of the hull axis as indicated by arrow V next to the surface 213. The vehicle is also rolled continuously about the hull axis as indicated by arrows V. The transmitter 211 emits a beam 214 which follows a helical path, and sweeps out a series of stripes 215 across the surface. The receiver 212 has a sensing axis which follows a corresponding helical path, and sweeps out a corresponding series of stripes across the surface. A control device (not shown) improves the effective resolution of the image captured by the sensor 212 by processing the sensor data from successive stripes to achieve synthetic extension of the sensor's aperture in two dimensions.

A similar principle can be employed in an alternative vehicle (not shown) in which the transmitter and sensor are oriented with their beams parallel to the hull axis, and the vehicle translates parallel to a surface at an angle to the hull axis. In this case the beams sweep out a curved path instead of a series of stripes on the surface.

The lack of external superstructure enables the vehicle 1 to be docked as shown in FIGS. 9*a* and 9*b*. A dock has a cylindrical inner wall 230 shown in cross-section. The dock may be formed in a ship's hull below the water line, or in a fixed structure such as harbour or offshore structure. The vehicle 1 moves into the dock by moving (as indicated by arrow V) along its hull axis until the vehicle is enclosed within the dock as shown in FIG. 9*b*. Rolling the vehicle as it translates into the dock provides added stability and enables accurate positioning. The vehicle can be deployed by reversing its propellers so that it exits the dock.

FIG. 9*c* shows part of an inductive electrical recharge system. An annular primary coil 231 in the dock couples inductively with an annular secondary coil 232 in the vehicle to recharge the vehicle batteries.

In a second docking arrangement shown in FIG. 10, the dock has a projection 240 which is received in the duct 5 and bears against the inner wall of the hull to secure it in place.

A third docking arrangement is shown in FIG. 11 for an alternative vehicle 260, similar in shape to the vehicle 100. In this case the cylindrical dock is replaced by a hollow cylindrical projection 250 which is shown in cross-section (although the vehicle 260 is not shown in cross-section). The projection 250 is received in the duct and bears against the inner wall of the hull to secure it in place. In this case the vehicle 260 is a towed variant of the "swept wing" design of FIG. 5*b* with a tether 261 attached to the bow fin 262. There is no superstructure (for instance propellers or fins) in the duct so the projection 250 can pass completely through the duct. The vehicle is deployed by angling the projection down so the vehicle slides off the projection under the force of gravity. An inductive recharge system may be employed in a similar manner to FIG. 9*c*.

FIGS. 12*a*, 12*b* and 12*c* are front, port side and plan views of a sixth vehicle 600. The hull of the vehicle is swept with respect to the hull axis 601, in common with the vehicle shown in FIGS. 5*a*-5*c*, but in this case the hull has a swept forward portion carrying a bow fin 602 and a stern fin 603; and a swept back portion carrying a bow fin 604 and stern fin 605. The vehicle operates as a glider and carries a buoyancy engine (not shown) and an inertial attitude control system (not shown) similar in structure to the system shown in FIG. 7. Thus the vehicle has a fully conformal outer shape with no superstructure either inside the duct or projecting from the exterior of the vehicle.

FIGS. 13*a* and 13*b* are front and port side views of a vehicle 700. The vehicle is shown with a propulsion system of the kind shown in FIG. 1, with twin thrust vector propulsors 705,706, one of the shrouds 708 being visible in FIG. 13*b*. The vehicle is tethered to a mother ship (not shown) by a harness tether system including a port tether 701 shown in FIG. 17*b* and a starboard tether (not shown) attached to the hull at an equivalent position on the starboard side. The tethers combine to form a single tether harness that provides data transfer. and transfer of drag loads during operation. The vehicle has an additional pair of propulsion devices 702,703 which are fixedly mounted flush with the external surface of the outer hull, and provide pitch control. A sensor 704 is shown at the stern of the vehicle.

FIGS. 14*a* and 14*b* are front and port side views of a vehicle 800. The vehicle is tethered to a mother ship (not shown) and towed by a single tether 801 which may also transmit data to and/or from the vehicle. The tether 801 is preferentially attached to the hull by a pivot (not shown), although an alternative bridle scheme may also be used satisfactorily. Four fins are fitted at the stern of the hull. Upper fin 802, lower fin 803 and port fin 804 are shown in FIG. 14*b* but the starboard fin is hidden. Each of the four fins can be pivoted as indicated in dashed line for fins 802, 803 to effect pitch and yaw control. The vehicle 800 is more rigid and less susceptible to wing flutter than a V-wing. It is also more efficient than a V-wing because of low induced drag and increased pitch stability because the corrective pitch moment is larger.

The vehicles described above can be used for autonomous unmanned undersea exploration, imaging, inspection, mapping and ocean science monitoring. In this case, the propelled vehicles may be of the order of 500 mm in diameter and 600 mm long, and the glider versions may be two to four times bigger. However the basic vehicle design is scaleable and may be utilized in very small vehicles with spans measured in a few centimeters, to very large ocean vehicles with spans measured in tens of metres. The vehicles can accommodate a variety of sensor configurations, including: lasers; geophones; hydrophones; low frequency, mid frequency and high frequency sonar transducer projectors; electro-magnetic sensors, linescan and two dimensional imaging sensors. The vehicles are also suitable for: docking, or parking in tubes, or ports, or garage; or touch-down, or lift-off operations on liquid beds.

The stability induced by continuous rolling enables the vehicle to "hover": that is, to maintain substantially no translational movement. This is in contrast to conventional autonomous underwater vehicles which lose stability at low speed. Whilst operating in "hover" mode, a feedback system may sense the proximity of the vehicle to an external object and control the position of the vehicle in response to the sensed proximity, for instance generating small amounts of thrust as required to keep the vehicle a fixed distance away from the object.

An alternative application for the vehicles described herein is long range bulk transport of bulk material (such as crude oil), in which the interior of the hull is filled with the material. In this design the annular hull length may be 20 metres, while the outer diameter may be constrained to 10 metres. The material is contained either within inner toroidal pressure vessels, or the outer hull, or both. The size and/or aspect ratio of the vehicle will be increased as required. For instance where a large vehicle payload needs to be carried, an extended payload section could be configured as a toroidal bay that would be fitted at some point along the vehicle axis. In applications of this type, where the vehicle is inclined at an angle to an ocean current the vehicle can drift off course to the side, due to drag and lift forces induced by the ocean current. However, by continuously rolling the vehicle about its axis, the sideways forces created by the ocean current are reduced. Instead, magnus forces are generated which tend to drive the vehicle up or down, but not to the side.

A further alternative application for vehicles of this type is to submerge the vehicle in a liquid-filled pipe (for instance a utility water pipe, or an oil pipe) for inspection, repair or other purposes. In this case the diameter of the vehicle will be chosen to be sufficiently small to be accommodated in the pipe.

Alternatively, in an undersea cable lay application a much larger vehicle may be specified so that long cables may be carried inside the outer hull and deployed from the vehicle. For example such a vehicle would carry an open toroidal stowage bay around which the heavy submarine tow cable would be wound, where such a bay would form one toroidal section within a large vehicle. A particular embodiment of this vehicle, therefore, employs an annular hull with length 5.6 metres, and an outer diameter of 4 metres. The propulsion system is as described earlier for the smaller vehicle, and spin is induced together with axial motion in order to deploy and lay the submarine cable autonomously.

Instead of being operated as a fully submersible submerged vehicle, the vehicles described above may be designed to operate as surface vehicles which are only partly submerged when in use. In this case, cameras and radio sensors are fixed at the top of the outer annular skin, and sonar sensors are located around the lower part of the toroidal hull. The surface vehicle has a similar construction and propulsion to the other vehicles described earlier, and may be implemented using either of the swept or unswept toroidal forms. The significant advantage offered by the annular form of the hull is enhanced stability while operating on or near the surface, when the toroidal form with low CofG and distributed mass provides an efficient wave piercing motion which is resilient to disturbances caused by waves, wind or swell, much more so than would be achieved by conventional surface vessels. This is of particular importance when surveillance, or imaging, or mapping operations would otherwise be compromised by unpredictable sensor motion arising from wave, wind or swell impact. Furthermore the twin thrust vector propulsor schemes shown in FIGS. 2*a*,2*b* 3*a*,3*b* and 4*a*-4*c* allow for adjustment of vehicle top surface and associated sensor height above the sea surface.

Figure 5D:
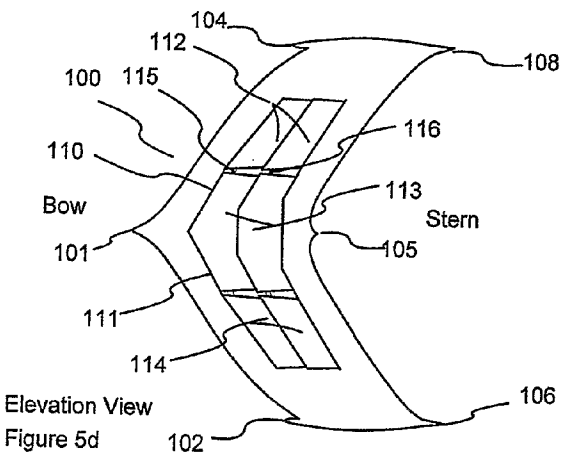

In further alternative embodiments of each of the aforesaid vehicles the annulus may include ports, or slots 110, 111, and feathered vanes 112, 113, 114 on either side of its two elevations. In one example described in FIG. 5*d*, the feathered vanes may be rotated around hinges 115, 116 which are located on toroidal bar sections which form part of the vehicle structure, where three such vanes may be used on each of two or more such toroidal bar sections on each of port and starboard annulus sides. Although FIG. 5*d* describes a particular embodiment where the slots and vanes are contained within the annulus, it should be clear that this principle may also be applied in the inverse configuration (not shown) where the vanes form part of the leading and trailing edges of the annulus.

An associated control device is used to independently drive or relax the vanes according to the immediate goals of the vehicle and the prevailing local conditions. When relaxed the vanes reduce the effects of cross-flow currents by allowing for efficient fluid flow around the vanes and through the annulus. The upper and lower vanes may be adjusted dynamically by the control device to effectively introduce positive or negative wingtwist into any or all quartiles of the toroid, which modulates the pitch, roll and yaw moments of the wingform and therefore can be used either to stabilize the vehicle or to induce rapid pitch, or yaw, or roll. In one example the vanes are driven by an electric brushless motor that sits within a sealed enclosure using a reduction ratio gear mechanism so that vane actuation within ±90° of travel can be achieved within approximately 0.5 seconds. It is obvious that the central feathered vanes pairs may also be used in a similar manner. In another example the feathered vanes may rotate around a shaft which is oriented normal to the toroid surface, and which approximately bi-sects the CofG of the vehicle, and where two such shafts and associated feathered vanes are included, and where the axes of both shafts subtend an angle of 90°, and where the axes of both shafts are aligned to 45° with respect to a vertical plane that coincides with the axis of the vehicle. Once again the feathered vanes may be relaxed, or they may be driven so as to move the fluid in any direction subtended by the plane described by the axes of the two shafts as coupled to the feathered vanes. In this example the feathered vanes and shafts may be driven directly by associated brushless DC electric motors, or they may be driven indirectly using a mechanical gear reduction ratio mechanism.

The high rotational symmetry of the hull shapes (as viewed along the hull axis) described herein gives advantages where the vehicle is to be operated in a continuous roll mode. However, the invention also covers alternative embodiments of the invention (not shown) including:

- embodiments in which the inner and/or outer walls of the outer hull do not appear circular as viewed along the hull axis. For instance the outer hull may have a polygonal annular shape (square, hexagonal etc)
- embodiments in which the duct is divided into two or more separate ducts by suitable partitions
- embodiments in which the outer hull itself defines two or more separate ducts
- embodiments in which the outer hull is evolved from a laminar flow hydrofoil as a body of revolution around the hull axis by an angle less than 360 degrees. In this case, the duct will be partially open with a slot running along its length. By making the angle greater than 180 degrees, and preferably close to 360 degrees, the hull will remain substantially annular so as to provide hydrodynamic lift at any angle of roll.

FIGS. 5*a*-*d* and 12*a*-12*c* illustrate a submersible glider with a buoyancy control engine, but in an alternative embodiment the hull profiles shown in FIGS. 5*a*-5*d* or FIGS. 5*a*-5*c* may be used in a submersible toy glider used, for instance, in a swimming pool. The profile of the glider of FIG. 5*d* (without the vanes) is most preferred in this application.

The invention claimed is:

1. A submersible vehicle having an outer hull which defines a hull axis and appears substantially annular when viewed along the hull axis, the interior of the annulus defining a duct which is open at both ends so that when the vehicle is submerged in a liquid, the liquid floods the duct; and a twin thrust vector propulsion system comprising one or more pairs of propulsion devices, each pair comprising a first propulsion device pivotally mounted at a fixed position on the interior of the annulus on a first side of the hull axis, and a second propulsion device pivotally mounted at a fixed position on the interior of the annulus on a second side of the hull axis opposite to the first propulsion device wherein each propulsion device generates a thrust vector which points in a direction which can be varied by pivoting the device, and wherein the propulsion devices can be pivoted between a first configuration in which their thrust vectors point in the same direction to provide a thrust force to propel the vehicle forward and along the hull axis, and a second configuration in which their thrust vectors point in different directions to cause the vehicle to roll around the hull axis.

2. A vehicle according to claim 1 wherein the propulsion devices are positioned in the duct.

3. A method of operating a submersible vehicle, the vehicle comprising an outer hull which defines a hull axis and appears substantially annular when viewed along the hull axis, the interior of the annulus defining a duct which is open at both ends so that when the vehicle is submerged in a liquid, the liquid floods the duct, the method comprising: submerging the vehicle in a liquid whereby the liquid floods the duct, and rolling the vehicle about its hull axis through a plurality of revolutions by the action of a propulsion system, the method further comprising pulsing on the propulsion system as the vehicle rolls about its hull axis, the propulsion system being pulsed on over a limited arc of said roll of the vehicle about its hull axis so that the vehicle is moved in a plane that lines normal to the hull axis.

* * * * *